US005354959A

United States Patent [19]

Yoshizumi et al.

[11] Patent Number: 5,354,959

[45] Date of Patent: Oct. 11, 1994

[54] CIRCUIT BREAKER

[75] Inventors: Toshiaki Yoshizumi; Mikio Hidaka; Yoshiki Hirano, all of Amagasaki, Japan

[73] Assignee: Mitsubishi Denki Kabushiki Kaisha, Tokyo, Japan

[21] Appl. No.: 34,866

[22] Filed: Mar. 19, 1993

[30] Foreign Application Priority Data

Apr. 14, 1992 [JP] Japan ..... 4-094165

[51] Int. Cl.[5] ..... H01H 33/42; H01H 33/50

[52] U.S. Cl. ..... 200/148 F; 200/144 AP; 200/148 R

[58] Field of Search ..... 200/144 R, 144 B, 144 AP, 200/145, 148 R, 148 A, 148 D, 148 F, 148 B, 150 D, 150 E, 150 F, 17 R

[56] References Cited

U.S. PATENT DOCUMENTS 4,215,256 7/1980 Sakaguchi et al. ..... 200/148 D
4,454,394 6/1984 Toyoda ..... 200/145
4,581,510 4/1986 Bischofberger et al. ..... 200/148 F

*Primary Examiner*—A. D. Pellinen
*Assistant Examiner*—Michael A. Friedhofer
*Attorney, Agent, or Firm*—Oblon, Spivak, McClelland, Maier & Neustadt

[57] ABSTRACT

A double-break type circuit breaker includes two resistor contacts which are to be connected in parallel with respectively two main contacts when the main contacts are closed. An engagement mechanism is provided for linking the main contacts operated by a first hydraulic operation apparatus and the resistor contacts operated by a second hydraulic operation apparatus.

8 Claims, 22 Drawing Sheets

CIRCUIT BREAKER

BACKGROUND OF THE INVENTION

1. Field of the Invention

The present invention relates to a circuit breaker to be used in an electric power system.

2. Description of the Prior Art

A convention circuit breaker which is a double-break type gas-insulated circuit breaker with closing resistors is described referring to FIGS. 17 to 22.

FIG. 17 is a sectional side view showing the constitution of the conventional circuit breaker in a closed state. In FIG. 17, elements which are positioned in left-hand half part in the figure are further sectioned and elements in right-hand half part are not sectioned. The elements in left-hand half part and the elements in right-hand half part are substantially the same and positioned substantially symmetrical.

In FIG. 17, an insulation gas such as $SF_6$ gas 102 is filled in a main tank 101. Two main contacts 200 are symmetrically positioned with respect to the center of the main tank 101 and they are supported by a frame conductor 301. The frame conductor 301 is supported by an insulation holder 302 in a center branch drum port of the main tank 101. The main contacts 200 and the frame conductor 301 are positioned on a center axis of the main tank 101. The main contacts 200 respectively consist of a stationary electrode 201 and a moving electrode 202.

FIG. 18 is a sectional side view showing the detailed constitution of a switching part of the conventional circuit breaker. As shown in FIG. 18, the stationary electrode 201 and the moving electrode 202 are held by an insulation tube 203. Conductors 204 of the stationary electrodes 201 serve as cooling drums for cooling hot insulation gas in a breaking operation of the circuit breaker. In rear parts of the conductors 204, exhaust openings **204*a* are formed for exhausting the hot insulation gas therethrough. Connection parts 105 are respectively provided on the conductors 204 to be connected to connection conductors 104 which are respectively held by insulation spacers 103 at both ends of the main tank 101, as shown in FIG. 17**.

As shown in FIGS. 17 and 18, the insulation tubes 203 respectively have a cylindrical shape. Capacitors 106 are provided on outer peripheries of respective of the insulation tubes 203, and they are electrically connected in parallel with the main contacts 200 in a manner so as to share voltages of the main contacts 200 evenly. On outer peripheries of respective ones of the conductors 204, two sets of plural resistors 500 are provided for restraining the surge when the circuit is closed. Resistor contacts 400 are respectively connected in series with respective sets of the resistors 500. The resistor contacts 400 are respectively provided on the outer peripheries of the insulation tubes 203 and obliquely below the main contacts 200. Furthermore, series connections of the resistor contact 400 and the resistors 500 are electrically connected in parallel with the main contacts 200. The moving electrodes 202 of the main contacts 200 and moving resistor contacts 409 of the resistor contacts 400 are respectively coupled with an insulation operation rod 303 via a link mechanism 300 which is provided in the frame conductor 301. The link mechanism 300 is connected to a hydraulic operation apparatus 700 in an operation housing 107 via another link mechanism 600 which is provided in the air.

Constitutions of the above-mentioned individual elements are described in detail. FIG. 18 shows a breaking state of the conventional circuit breaker. In FIG. 18, each of the stationary electrode 201 of the main contact 200 constituted essentially of a main stationary contact 205, a stationary arc contact 206, a shield 207 and the conductor 204. The moving electrode 202, which is positioned opposing to the stationary electrode 201, is constituted essentially of a main moving contact 208, a moving arc contact 209, a nozzle 210, a puffer cylinder 211, a piston 213 and a finger contact 214. A piston rod 212 of the piston 213 is slidably held on the frame conductor 301 in a manner to make the finger contact 214 serve as a guide. A stationary resistor contact 401, which is positioned obliquely below the stationary electrode 201, is slidably held on a resistor contact case 402. The resistor contact case is fixed on the shield 207 via an insulation base 403.

As shown in FIG. 18, each piston rod 212 is linked to a main lever 305 via a link 304. Each main lever 305 is rotatably held on the frame conductor 301. The insulation rod 303 is coupled to both (right and left sides in the figure) of the main levers 305 via other links 306. Each of the moving resistor contact 409 is linked to an end **308*a* of a lever 308 via a link 307. Each lever 308 is rotatably borne at substantially the center thereof by a pin 309. The pin 309 is provided at substantially the center between a rotation center of the main lever 305 and a coupling part of the link 304 and the main lever 305. The other end of the lever 308 is rotatably borne on a link 310. The link 310 is rotatably borne on the frame conductor 301. In such a link mechanism, the motion of the link part of the link 307 and the lever 308 due to the rotation of the main lever 305 can be considered to be a linear motion, and thereby any transverse force does not occur in the moving resistor contact 409**.

An upper end **303*a* of the insulation rod 303 is guided by a guide 311 which is provided on the frame conductor 301, and a lower end 303*b* of the insulation rod 303 is fixed on a shaft 601. The insulation rod 303 is positioned at the center of the insulation holder 302. The shaft 601 penetrates the center of the bottom face 302*a* of the insulation holder 302. A shaft seal 602 is provided between the shaft 601 and the insulation holder 302 for guiding the sliding motion of the shaft 601 and for maintaining the seal of the $SF_6$ gas 102 in the main tank 101. An end 601*a* of the shaft 601 in the air is coupled to a hydraulic piston 701 of the hydraulic operation apparatus 700 via a link mechanism which is constituted by a link 603, a conversion lever 604 for perpendicularly converting the moving direction and a rod end 605**.

The hydraulic operation apparatus 700 further comprises an accumulator for charging the oil and a oil pump unit (not shown in the figure) for increasing the pressure of the oil.

FIG. 19 shows a detail constitution of the resistor contact 400 in a breaking state of the circuit breaker. In FIG. 19, a restoration spring 404 is provided in an inner space of the resistor contact 401. An end **404*a* of the restoration spring 404 contacts an inside face 401*a* of the resistor contact 401 and the other end 404*b* of the restoration spring 404 contacts a piston 405 which is fixed on the resistor contact case 402. In the breaking state, the resistor contact 401 is pushed out by a pressing force of the restoration spring 404 since the resistor contact case 402 serves as a stopper. Orifices 406 are provided on the piston 405 for serving as a damper when the stationary resistor contact 401 slides. On the outer surface of the stationary resistor contact 401, a contact piece 407 is provided for electrically connecting the stationary resistor contact 401 to the resistor contact case 402. On an extension of the center axis of the stationary resistor contact 401, resistor elements 501 are provided via an adapter 408 in a manner to be connected electrically in series to the stationary resistor contact 401. The moving resistor contact 409, which is positioned opposing to the stationary resistor contact 401, is movably held by the frame conductor 301 and electrically connected to the frame conductor 301 by a contact piece 410**.

FIG. 20 shows an installation of the resistors 500. For restoring the surge which occurs in the closing operation of the circuit breaker, the resistor contact 400, which is provided in parallel with the main contact 200, is closed prior to the closing of the main contact 200 and thereby, the resistors 500 which are provided in series with the resistor contact 400 are electrically connected. Generally, each resistor 500 consists of a series connection of many resistor elements 501, thereby a necessary valve of the resistor 500 or the series connection of the resistors 500 is/are given by the series connection of the resistor elements 501. And the heat load of the resistor 500 is partially shared by the resistor elements 501. Each resistor element 501 has a disk shape and is held by an insulation bar 502 which penetrates the center hole of the resistor element 501. An end 502*a* of the insulation bar 502 is fixed on an adapter 408 and the other end 502*b* is fixed on a conductor 503 which is used for connecting another resistor 500'. Another adapter 504 is provided to electrically contact with the left side of the series connection of the resistor elements 501 in the figure. A coil spring 505 is provided between the conductor 503 and the adapter 504 for supplying a force to the resistor elements 501. The conductor 503 is shielded by a shield 506 which is used for weakening the electric field. Similarly, the next resistors 500' and 500'' are electrically connected in series to each other and held by an insulation base 507 on a shield 207. The other end 510 of the series connection of the resistors 500' and 500'' is electrically connected to a conductor 204, thereby the main contact 200 is electrically in parallel to the series connection of the resistors 500, 500' and 500''.

The motion of the conventional circuit breaker is described. The closing motion shown in FIG. 18 is executed as follows. By receiving a closing command (from a control apparatus not shown in the figure), the piston 701 of the hydraulic operation apparatus 700 and the rod end 605 start to move in the left-hand half part in the figure. Thereby, the lever 604 rotates counterclockwise, and the shaft 601 moves upward via the link 603. The elements which are positioned in right- and left-hand half parts in the figure move symmetrically, so that the explanation of the motion is mainly referring to the left-hand half part members.

When the shaft 601 moves upward, the insulation operation rod 303 also moves upward. The main lever 305, which is coupled to the insulation operation rod 303 via the link 306, rotates counterclockwise. As a result, the puffer cylinder 211 of the main contact 200 is moved in the left-hand half part via the link 304 and the piston rod 212.

On the other hand, the lever 308, which is linked to the main lever 305 by the pin 309, rotates clockwise around the coupling point 308*b* to the link 310 by the rotation in the counterclockwise direction of the main lever 305. The moving resistor contact 409 moves in left-hand half part to approach the stationary resistor contact 401 via the link 307. At first, the moving resistor contact 409 contacts the stationary resistor contact 401, and thereby, the resistor contact 400 turns to a closing state. At this time, the moving resistor contact 409 pushes the stationary resistor contact 401, and the restoration spring 404 is compressed by pushing of the stationary resistor contact 401 to the resistor contact case 402. Next, the moving arc contact 209 contacts the stationary arc contact 206. Furthermore, the main moving contact 208 contacts the main stationary contact 205. Thereby, the main contact 200 is closed.

The stationary resistor contact 401 is constituted to be able to move with the motion of the moving resistor contact 409. When the stationary resistor contact 401 is pressed by the moving resistor contact 409, the insulation gas 102 of $SF_6$ in a space formed between the piston 405 and the stationary resistor contact 401 is compressed. When the compressed insulation gas 102 is exhausted from the orifice 406, the resistance serves as a damping force. When the piston 701 reaches a closing position, the closing motion of the circuit breaker has been completed. The closing state of the conventional circuit breaker is shown in FIG. 21.

Next, the breaking motion of the conventional circuit breaker is described. From the closed state of the conventional circuit breaker shown in FIG. 21, when a breaking command is issued from the control apparatus (not shown in the figure), the piston 701 of the hydraulic operation apparatus 700 and the rod end 605 start to move in right-hand half part in the figure. The lever 604 rotates clockwise and the shaft 601 moves downward via the link 603.

When the shaft 601 moves downward, the insulation operation rod 303 also moves downward. The main lever 305, which is linked to the insulation operation rod 303 via the link 306, rotates clockwise and the puffer cylinder 211 of the main contact 200 moves to the frame conductor 301 which is positioned in the center of the main tank 101 via the link 304 and the piston rod 212.

On the other hand, the lever 308, which is linked to the main lever 305 by the pin 309, rotates counterclockwise around the coupling point 308*b* to the link 310 by following the rotation of the main lever 305 clockwise. The moving resistor contact 409 also moves to the frame conductor 301 via the link 307. The stationary resistor contact 401 moves rightward by the pressure of the restoration spring 404 following the movement of the moving resistor contact 409 rightward. However, the moving speed of the stationary resistor contact 401 is slower than that of the moving resistor contact 401, since the charged energy of the restoration spring 404 is small and the orifice formed on the piston 405 serves as a damper. Therefore, the resistor contact 400 reaches a breaking state soon. After that, the main moving contact 208 of the main contact departs from the main stationary contact 205. The moving arc contact 209 also departs from the stationary arc contact 206, and an arc occurs between them. A state on the way of the breaking operation of the conventional circuit breaker is shown in FIG. 22.

The compressed insulation gas 102 by the piston 213 and the puffer cylinder 211 blows the arc, and thereby, the current flowing the circuit breaker is cut. Most of the insulation gas 102 heated by the arc passes through the conductor 204. The insulation gas 102 is cooled by the conductor 204 and exhausted from the opening 204*a*. When the piston 701 reaches the breaking position, the breaking operation of the conventional circuit breaker has been completed. The breaking state of the conventional circuit breaker is shown in FIG. 18.

When the voltage of the electric power system becomes higher and the conventional circuit breaker is used, for example, in 1000 kv system, it is demanded to restrain an overvoltage not only in the closing operation but also in the breaking operation of the circuit breaker for making a transmission-transformation system and/or transmission lines economical. In the conventional circuit breaker configured above, the resistor contact 400 is broken prior to the breaking of the main contact 200. Therefore, the overvoltage in the breaking operation can not be restrained. For restraining the overvoltage in the breaking operation too, a resistor-breaking type circuit breaker, which keeps to contact a resistor contact for a predetermined time period after breaking the main contact, is necessary. For such time period of the contacting time of the resistor contact, a time of about 25 ms is necessary for a computer simulation of the model system. The time period of 25 ms in the breaking operation is longer than that of 10 ms in the closing operation.

On the other hand, the circuit breaker is required to operate faster in the breaking operation than in the closing operation for obtaining a high circuit breaking performance, generally. For satisfying such condition, it is necessary that the resistor contact is opened in the vicinity of the final step of the breaking operation after the main contact is opened. Therefore, another special driving apparatus and a delay operation mechanism are required to constitute the high-voltage type circuit breaker.

OBJECT AND SUMMARY OF THE INVENTION

The present invention has been made in order to solve the above-mentioned problems. An object of the present invention is to provide an improved circuit breaker fitting to the high voltage electric power system with down sizing and high reliability of the moving mechanism.

In order to achieve the above-mentioned object, the circuit breaker In accordance with the present invention comprises:

a tank filled with an insulation gas;

two main contacts which are electrically connected In series and provided in the tank in a manner that main moving contacts of the main contacts are driven in the axial direction of the tank for contacting and departing from stationary main contacts of the main contacts;

series connections of resistors and a resistor contact which are respectively provided in the tank in a manner being electrically connected In parallel with the main contacts;

a first insulation operation rod and a second insulation operation rod which are driven in a direction perpendicular to the axis of the tank and provided between the main contacts;

a first link mechanism for coupling between one end of the first insulation operation rod and the main contact;

a second link mechanism for coupling between one end of the second insulation operation rod and the resistor contact;

a first hydraulic operation apparatus and a second hydraulic apparatus which are provided below the tank;

a third link mechanism for coupling between the other end of the first insulation operation rod and the first hydraulic operation apparatus;

a fourth link mechanism for coupling between the other end of the second insulation operation rod and the second hydraulic operation apparatus; and an engagement mechanism for restricting operations of the first link mechanism and second link mechanism in a manner that the main contact and the resistor contact are moved to close at substantially the same speed, and the main contact is closed after the resistor contact is closed.

In the above-mentioned circuit breaker in accordance with the present invention, the moving directions of the two main contacts are opposite to each other in the breaking operation and the closing operation;

the moving direction of the first insulation operation rod is arranged perpendicular to the moving directions of the main contacts;

the first link mechanism comprises a first link which is coupled to a main moving contact of the main contact, a second link which is coupled to an end of the first insulation operation rod, and a first lever which is coupled between the other end of the second link and the other end of the first link and rotatably borne on a fixed base;

the moving directions of the two resistor contacts are opposite to each other in the breaking operation and the closing operation;

the moving direction of the second insulation operation rod is arranged perpendicular to the moving directions of the resistor contact;

the second link mechanism comprises a fourth link which is coupled to a moving resistor contact of the resistor contact, a fifth link which is coupled to an end of the second insulation operation rod, and a second lever which is coupled between the other end of and the fourth link the other end of the fifth link and rotatably borne on a fixed base;

the third link mechanism comprises a first shaft which is provided below the first insulation operation rod and connected to a bottom end of the first insulation operation rod, and which is arranged to project to air through a first hermetic seal.

a sixth link of which an end is coupled to the first shaft, a fifth lever of which an end is coupled to the other end of the sixth link and rotatably supported by an operation housing, and a first rod end which is coupled between the other end of the fifth lever and an end of a first hydraulic piston of the first hydraulic operation apparatus; and the fourth link mechanism comprises a second shaft which is provided below the second insulation operation rod and connected to a bottom end of the second insulation operation rod, and which is arranged to project to air through a second hermetic seal, an eighth link of which an end is coupled to the second shaft, and a fourth lever of which an end is coupled to the other end of the eighth link and rotatably supported by the operation housing, and a second rod end which is coupled between the other end of the fourth lever and an end of a second hydraulic piston of the second hydraulic operation apparatus.

Furthermore, in the circuit breaker in accordance with the present invention, the engagement mechanism comprises a third lever which is rotatably provided on an main moving contact side arm of the first lever, and a third link of which an end is rotatably supported by the fixed base and the other end is coupled to an end of the third lever;

the main contact and the resistor contact being moved to close at substantially the same speed, and the main contact being closed after the resistor contact is in closed state in a manner such that the other end of the third lever is kept in contact with a coupling point between the fourth link and the second lever in the closing operations of the main contact and the resistor contact.

Still further, in the circuit breaker in accordance with the present invention, the circuit breaker comprises a latch mechanism which is provided to interlock between the third link mechanism and the fourth link mechanism, and to restrict the motion of the fourth link mechanism in the closed state of the main contact and the resistor contact;

the latch mechanism engaging with the fourth link mechanism to stop the breaking motion of the resistor contact operated by the second hydraulic operation apparatus when the main contact start to move in a breaking direction;

further the latch mechanism being released from the engagement with the fourth link mechanism so as to break the resistor contact operated the second hydraulic operation apparatus when the fifth lever of the third link mechanism is rotated in a predetermined angle in the breaking operation of the main contact.

In the circuit breaker in accordance with the present invention which is configured above, the main contacts are operated by the first hydraulic operation apparatus via the first insulation operation rod, and the resistor contacts are operated by the second hydraulic operation apparatus via the second insulation operation rod.

In the closing operation of the main contacts and the resistor contacts of the above-mentioned circuit breaker of the present invention, the main contacts and the resistor contacts can be operated in a constant timing that the main contacts are closed after the resistor contacts are in the closed state in a manner such that one end of the third lever is constructed to contact a coupling point between the fourth link and the second lever in the closing operation of the circuit breaker.

In the breaking operation of the main contacts and the resistor contacts of the above-mentioned circuit breaker, the fourth link mechanism which is locked by the engagement with the latch is released when the main contact is broken and the latch is released from the fourth link mechanism by the rotation of the fifth lever at a predetermined angle. Therefore, even if the circuit breaker receives a mechanical shock or vibration owing to the breaking operation of the main contact, the resistor contact is kept in a closed state until the predetermined time passes since the main contact is broken. As a result, the circuit breaker in accordance with the present invention is advantageous in its reliability of the breaking operation.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 15(*b*) is a front view showing the engagement mechanism of FIG. 15(*a*).

FIG. 16(*b*) is a front view showing the engagement mechanism of FIG. 16(*a*).

It will be recognized that some or all of the Figures are schematic representations for purposes of illustration and do not necessarily depict the actual relative sizes or locations of the elements shown.

DESCRIPTION OF THE PREFERRED EMBODIMENTS

In the following paragraphs, a circuit breaker of the present invention will be described in detail concerning the preferred embodiments shown in the attached drawings.

First Embodiment

Figure 1:
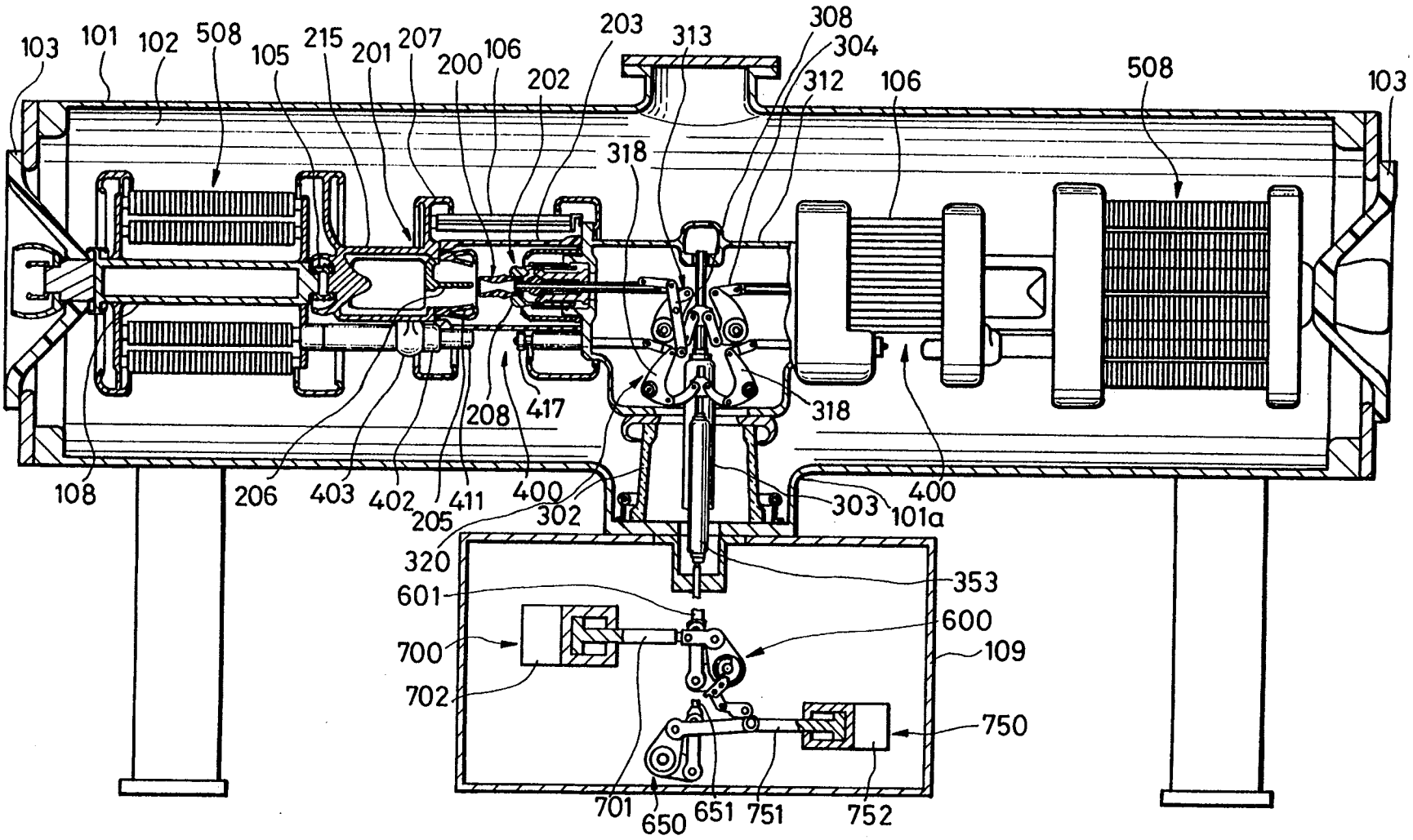
FIG. 1 is a sectional side view showing the constitution of a circuit breaker of a first embodiment in accordance with the present invention.
Figure 2:
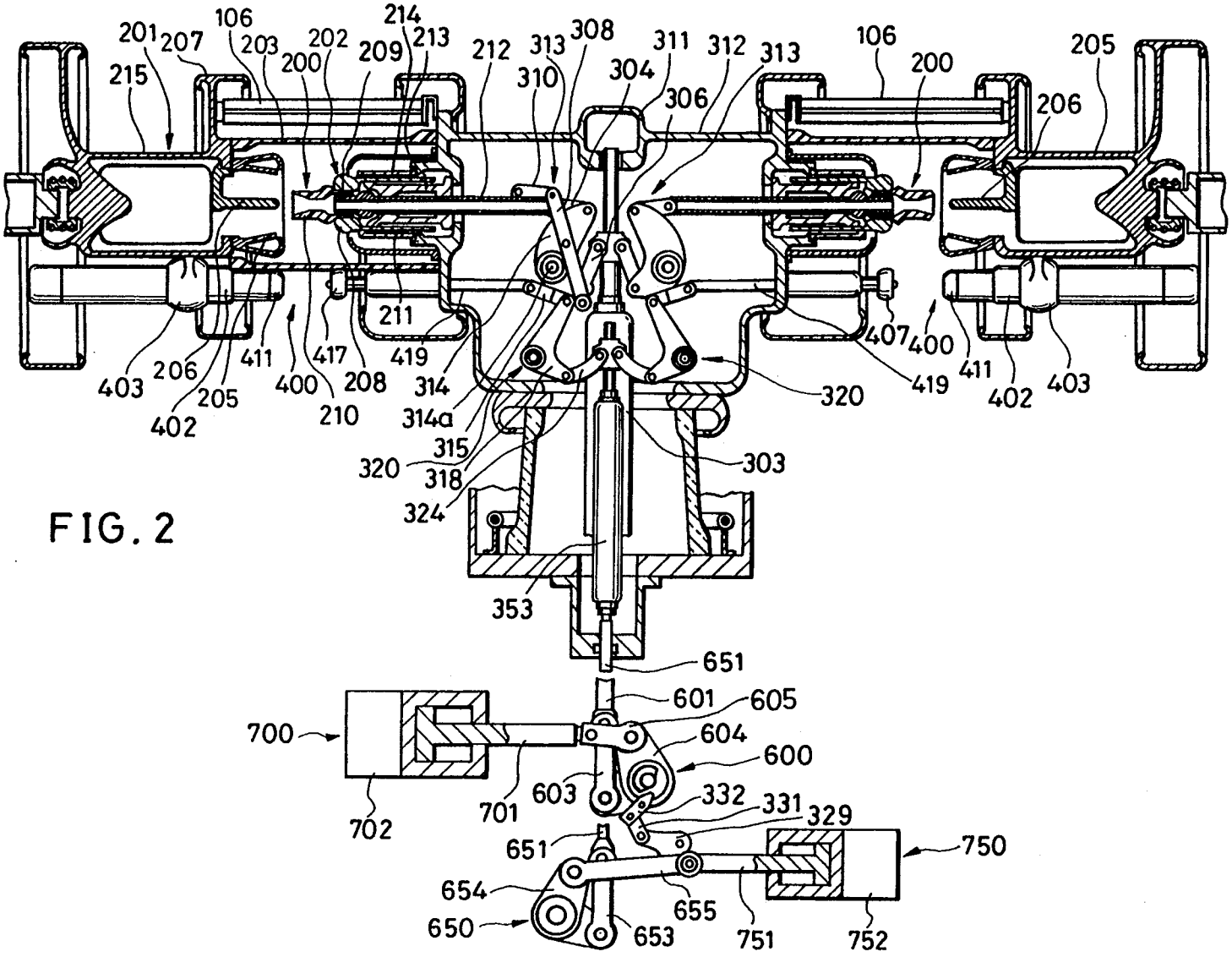
FIG. 2 is a sectional side view showing a detailed constitution of a switching part of the circuit breaker shown in FIG. 1.

Hereafter, a first embodiment of a circuit breaker in accordance with the present invention is described concerning the accompanying drawings of FIGS. 1 to 14. FIG. 1 is a sectional side view of a constitution of the circuit breaker of the first embodiment. In FIG. 1, elements which are positioned in the left-hand half part in the figure are further sectioned, and elements which are positioned in the right-hand half part are not sectioned. The elements in left-hand half part and the elements in right-hand half part are substantially the same. FIG. 2 is a sectional side view showing a detailed constitution of a switching part of the circuit breaker shown in FIG. 1.

In FIG. 1, an insulation gas 102, such as $SF_6$ gas is filled in an inner space of a main tank 101. Both (right and left) main contacts 200 are held by a frame conductor 312 in the main tank 101. The frame conductor 312 is supported by an insulation holder 302 in a branch part 101*a* of the main tank 101. The (right and left) main contacts 200 are positioned in a manner that the center axis of the main contacts 200 is on the center axis of the main tank 101.

The following descriptions are mainly referring to the elements positioned in left-hand half part of FIG. 1, and the elements positioned in right-hand half part have substantially the same constructions and functions as those in the left-hand half part. Therefore, most of the descriptions of the elements in right-hand half part are omitted.

The main contact 200 consists of a stationary electrode 201 and a moving electrode 202, and these are mechanically connected by an insulation tube 203. A conductor 215 of the stationary electrode 201 serves as a cooling tube for cooling insulation gas which has been heated in a breaking operation of the circuit breaker. Insulation spacers 103 are provided on both ends of the main tank 101 and connection conductors 108 are respectively held by the insulation spacers 103. Conductive connector 105 is provided between an end of the conductor 215 and the connection conductor 108 for electrically connecting them.

The above-mentioned insulation tube 203 is formed in a cylindrical shape. A number of capacitors 106 are provided around an outer periphery of the insulation tube 203, and terminals thereof are electrically connected in parallel with the main contact 200 to share the voltages of two main contacts 200 evenly.

On outer periphery of the connection conductor 108, a plurality of resistors 508 are provided for restraining the surge when the circuit breaker is closed or broken. A resistor contact 400, which is provided electrically in series with the resistors 508, is positioned on the outer periphery of the insulation tube 203 and below the center axis of the main tank 101. The resistor contact 400 is electrically connected in parallel with the main contact 200. The center axes of the both resistor contacts 400 which are positioned in the left-hand half part and the right-hand half part in FIG. 1 are arranged on the same line which is parallel to the center axis of the main tank 101.

Figure 3:
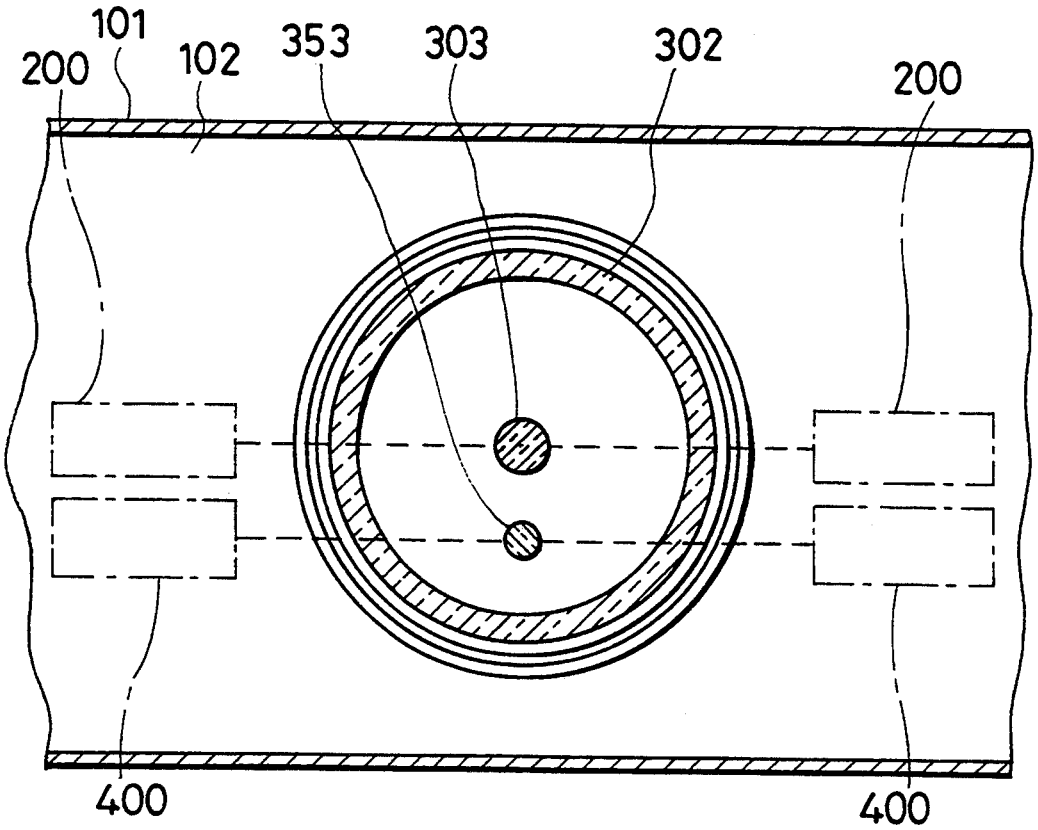
FIG. 3 is a sectional plane view showing the arrangement of insulation operation rods of the circuit breaker shown in FIG. 1.

As shown in FIG. 2, the moving electrode 202 of the main contact 200 is coupled with a first insulation operation rod 303 via a first link mechanism 313 which is provided in the frame conductor 312. FIG. 3 is a sectional plan view showing arrangements of the first insulation operation rod 303 in the insulation holder 302 of the circuit breaker. As shown in FIG. 3, the first insulation operation rod 303 is arranged at a substantially vertical center axis of the insulation holder 302. The first insulation operation rod 303 is connected with a first hydraulic operation apparatus 700 via a third link mechanism 600 which is provided in the air. The first hydraulic operation apparatus 700, which is provided in an operation housing 109 as shown in FIG. 1, comprises a first hydraulic piston 701, a first hydraulic controller 702, an accumulator, an oil pump unit and so on.

On the other hand, as shown in FIGS. 1 and 2, the moving resistor contact 417 of the resistor contact 400 is coupled with a second insulation operation rod 353 via a second link mechanism 320 which is provided in the frame conductor 312. The second insulation operation rod 353 is eccentrically arranged in the insulation holder 302 as shown in FIG. 3. The second insulation operation rod 353 is connected with a second hydraulic operation apparatus 750 via a fourth link mechanism 650 which is provided in the air. The second hydraulic operation apparatus 750, which is provided in the operation housing 109 shown in FIG. 1, comprises a second hydraulic piston 751, a second hydraulic controller 752, an accumulator, an oil pump unit and so on, similarly to the construction as the above-mentioned first hydraulic operation apparatus 700.

As shown in FIG. 2, the stationary electrode 201 of the main contact 200 comprises a main stationary contact 205, a stationary arc contact 206, a shield 207 and a conductor 215. The moving electrode 202, which is arranged to face to the stationary electrode 201, comprises a main moving contact 208, a moving arc contact 209, a nozzle 210, a puffer cylinder 211, a piston 213 and a finger contact 214.

Figure 4:
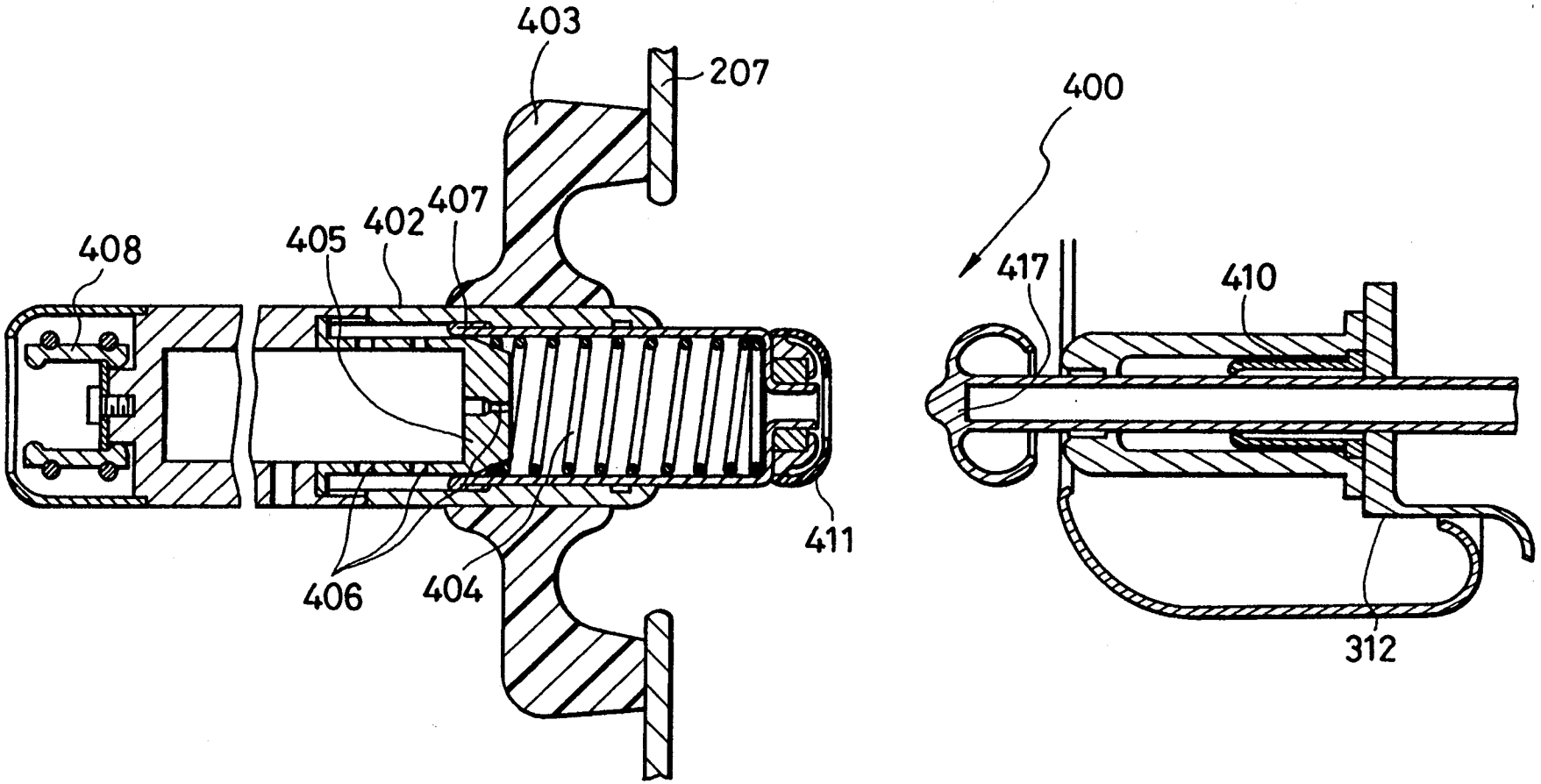
FIG. 4 is a sectional side view showing the detailed constitution of a resistor contact of the circuit breaker shown in FIG. 1.

FIG. 4 is a sectional side view showing a detailed constitution of a resistor contact 400 of the circuit breaker shown in FIG. 1. In FIG. 4, the stationary resistor contact 411, which is positioned below the center axis of the main tank 101, is slidably held by a resistor contact case 402. The resistor contact case 402 is fixed to the shield 207 via an insulation base 403. In a breaking state of the resistor contact 400, the stationary resistor contact 411 is pushed out by a pressing force of a restoration spring 404 because the resistor contact case 402 serves as a stopper. Orifices 406 is provided on a piston 405 for serving as damper when the stationary resistor contact 411 slides. On the outer surface of the stationary resistor contact 411, a contact piece 407 is provided for electrically connecting the stationary resistor contact 411 to the resistor contact case 402. On an extension of the center axis of the stationary resistor contact 411, resistor elements of the resistors 508 are provided via a connector 408 in a manner to be connected electrically in series to the stationary resistor contact 411. The moving resistor contact 417, which is positioned opposing the stationary resistor contact 411, is movably held by the frame conductor 312 and electrically connected to the frame conductor 312 by a contact piece 410.

Figure 5:
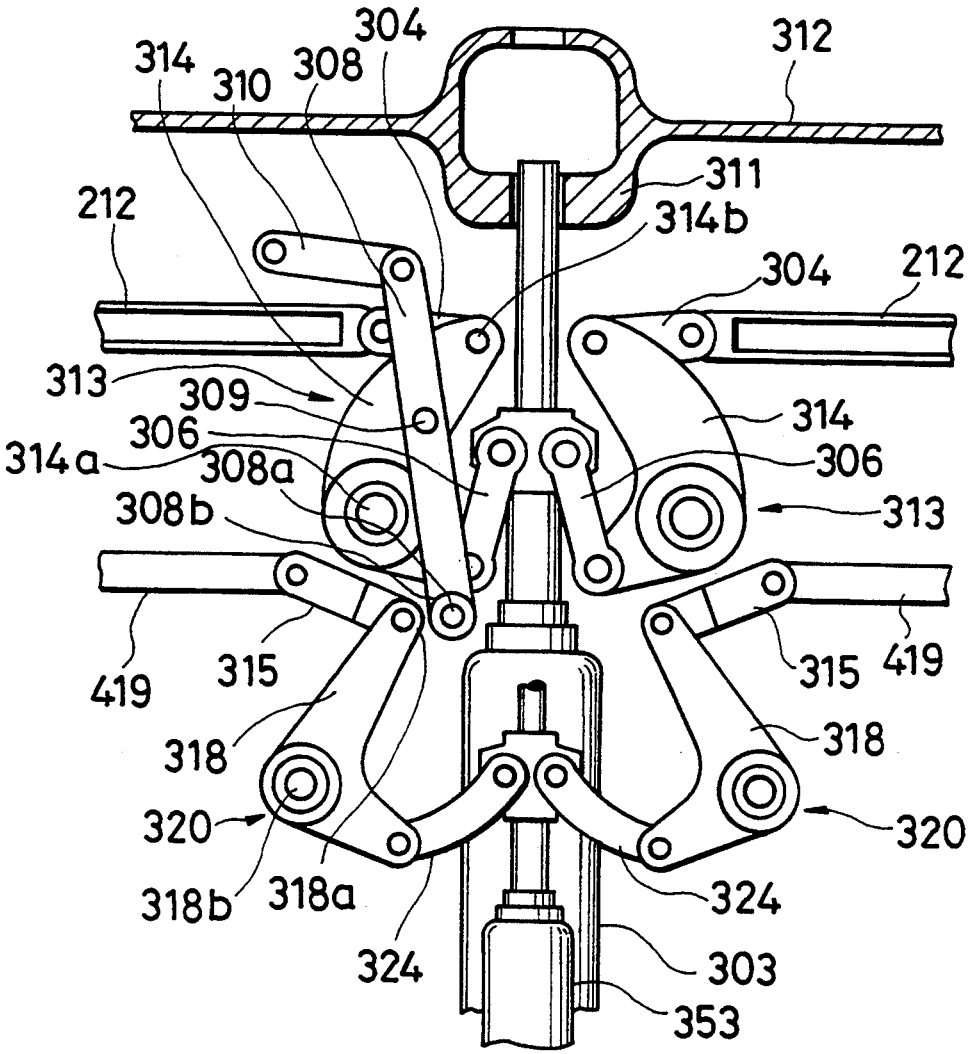
FIG. 5 is a side view showing a detailed constitution of a first link mechanism and the second link mechanism in the circuit breaker shown in FIG. 1.

FIG. 5 is a side view showing the first link mechanism 313 and the second link mechanism 320 of the circuit breaker shown in FIG. 1. In FIG. 5, a piston rod 212, which is connected to the piston 213 of the moving electrode 202, is coupled to a first lever 314 via a first link 304 of the first link mechanism 313. The first lever 314 is rotatably held by the frame conductor 312. Furthermore, the first lever 314 is coupled to the first insulation operation rod 303 via a second link 306 of the first link mechanism 313. As shown in FIG. 5, the above-mentioned first lever 314 positioned in the left-hand half part of the figure is also provided in right-hand half part.

A rod 419, which is positioned in the left-hand half part of FIG. 5, is provided to contact with a bottom end of a third lever 308 via a fourth link 315. The third lever 308 is rotatably held by a pin 309 provided on the first lever 314. The pin 309 is arranged at a substantial center between the rotation center 314*a* of the first lever 314 and the coupling point 314*b* for connecting the first link 304 and the first lever 314. The third lever 308 is rotatably held by a third link 310 which is also rotatably held on the frame conductor 312.

On the other hand, the fourth link 315, which is connected to the rod 419, is coupled to the second lever 318 which is rotatably held at a rotation center 318*b* of the second lever 318 by the frame conductor 312.

The third lever 308 has a roller 308*b* which is rotatably held by a pin 308*a* on the bottom end of the third lever 308. The roller 308*b* is arranged to contact to a coupling point 318*a* of the fourth link 315 and the second lever 318 by rotating the first lever 314 when the main contact 200 is moved in a closing operation. In a breaking state of the circuit breaker shown in FIG. 5, the roller 308*b* is arranged to have a gap from the coupling point 318*a*.

The second levers 318, 318 (right and left) are symmetrically coupled to the second insulation operation rod 353 via fifth links 324, 324, respectively.

Figure 6:
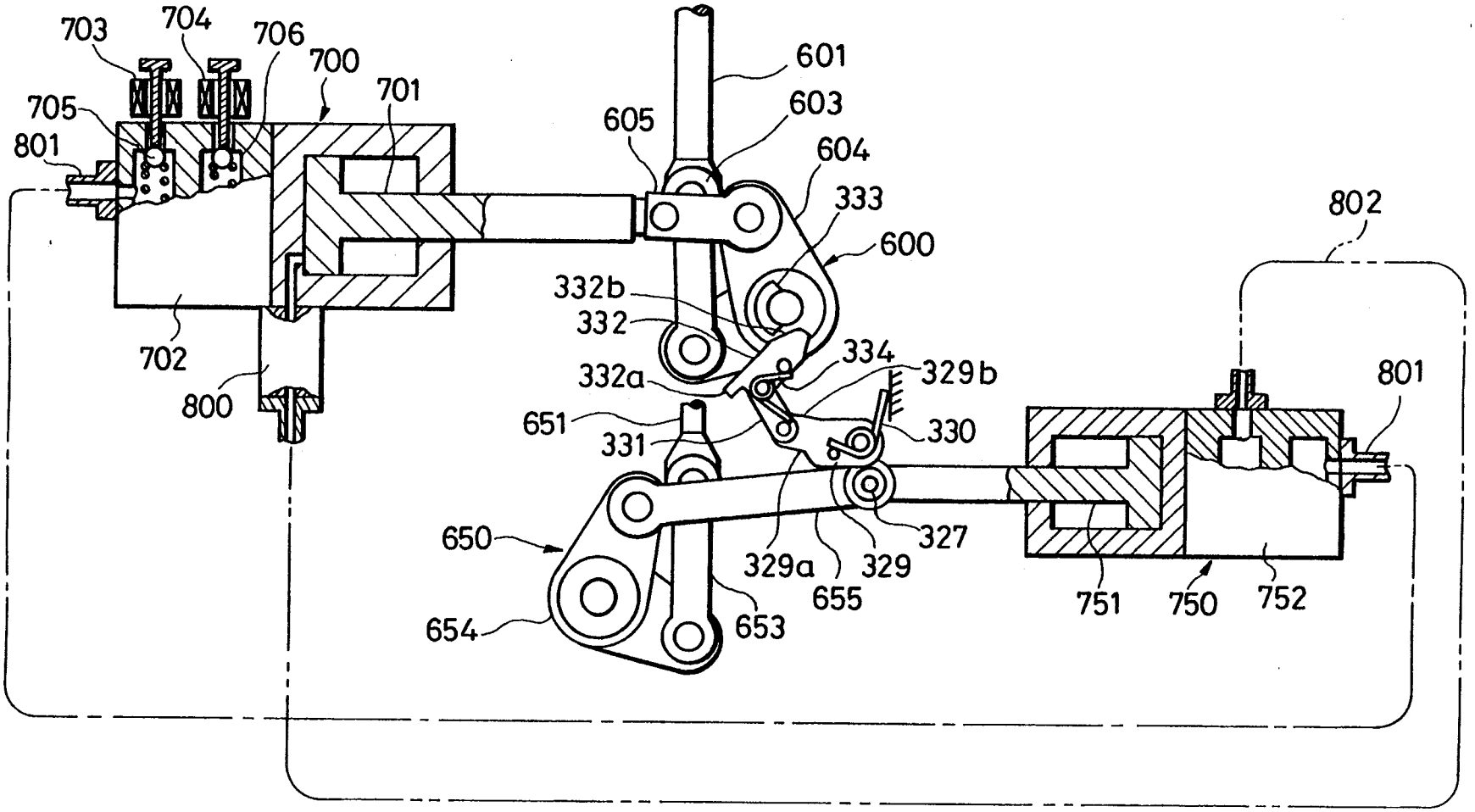
FIG. 6 is a side view showing the detailed constitution of a third link mechanism and a fourth link mechanism in the circuit breaker shown in FIG. 1.

As shown in FIG. 2, the upper end of the first insulation operation rod 303 is guided by a guide 311 which is formed on the frame conductor 312. The lower end of the first insulation operation rod 303 is fixed to the first shaft 601 which is operated by the first hydraulic operation apparatus 700. The first shaft 601 penetrates the main tank 101 through a hermetic seal (not shown), and thereby the insulation gas 102, such as $SF_6$ gas filled in the main tank 101, is gas-tightly sealed in the main tank 101. FIG. 6 is a side view showing the third link mechanism 600 which is coupled to the first shaft 601. In FIG. 6, the lower portion of the first shaft 601 disposed in the air is coupled to the first hydraulic piston 701 of the first hydraulic operation apparatus 700 via the third link mechanism 600 constituted by a sixth link 603, a third lever 604 and a first rod end 605. The third lever 604 is provided for changing the horizontal movement of the first hydraulic piston 701 into the vertical movement of the first shaft 601.

On the other hand, the upper end of the second insulation operation rod 353 is guided by a guide (not shown) which is formed on the frame conductor 312 by the same mechanism as the guide 311 for the first insulation operation rod 303 shown in FIG. 5. The lower end of the second insulation operation rod 353 is fixed to the second shaft 651 which is operated by the second hydraulic operation apparatus 750. The second insulation operation rod 353 is eccentrically positioned in the insulation holder 302 which dielectrically supports the frame conductor 312 as aforementioned in FIG. 3. In other words, the second insulation operation rod 353 is tandem arranged in parallel with the first insulation operation rod 303 located at a vertical center of the insulation holder 302. As shown in FIG. 2, the second shaft 651, which is connected to the second insulation operation rod 353 as shown in FIG. 2, penetrates the main tank 101 through a hermetic seal 652, and thereby the insulation gas 102, such as $SF_6$ gas filled in the main tank 101, is gas-tightly sealed in the main tank 101. As shown in FIG. 6, the lower portion of the second shaft 651 disposed in the air is coupled to the second hydraulic piston 751 of the second hydraulic operation apparatus 750 via the fourth link mechanism 650 constituted by an eighth link 653, a fourth lever 654 and a second rod end 655. The fourth lever 654 is provided for changing the horizontal movement of the second hydraulic piston 751 into the vertical movement of the second shaft 651.

The first hydraulic operation apparatus 700 and the second hydraulic operation apparatus 750 are arranged so as to be operated in reverse directions of the first hydraulic piston 701 and the second hydraulic piston 751 each other, and operating axes of them are arranged at different heights.

As shown in FIG. 6, a latch 329 is provided above the second rod end 655, which is coupled between the second hydraulic piston 751 and the fourth link mechanism 650. The latch 329 is located in a space between the first hydraulic operation apparatus 700 and the second hydraulic operation apparatus 750, and is rotatably held on the operation housing 109. In the breaking state of the circuit breaker shown in FIG. 6, the latch 329 receives a rotation force in the counterclockwise direction by the restoration spring 330, and thereby, the latch 329 is contacting the second rod end 655 in the breaking state. The latch 329 has a coupling part 329*a* to be engaged with a roller 327 when the aforementioned resistor contact 400 is in the closed state. An end 329*b* of the latch 329 is rotatably coupled to a seventh link 331. The seventh link 331 is rotatably coupled to a trigger 332. The trigger 332, which is rotatably held on the operation housing 109 at substantially the center of the trigger 329, has a stopper part 332*a* and a contact part 332*b*. The stopper part 332*a* is formed on the lower end of the trigger 332, and the contact part 332*b* is formed on the upper end of it. The contact part 332*b* is pushed by a cam 333 at a final step of the breaking operation of the main contact 200. The cam 333 is provided on the third lever 604 of the third link mechanism 600 for operating the resistor contact 400. Another restoration spring 334 is provided between the seventh link 331 and the trigger 332, so as to supply a force for making the stopper part 332*a* of the trigger 332 contact the seventh link 331 in every time.

In FIG. 6, the first hydraulic operation apparatus 700 comprises the first hydraulic piston 701 and the first hydraulic controller 702 has a closing electric magnet 703 and a breaking electric magnet 704. The closing electric magnet 703/or the breaking electric magnet 704 is excited by receiving a closing/or a breaking command from an external apparatus, and drives a closing hydraulic valve 705/or a breaking hydraulic valve 706 in response to the command, respectively. An amplifier (not shown) in the first hydraulic controller 702 amplifies the hydraulic signal from each hydraulic valve 705, 706 in order to control an oil pressure for operating the first hydraulic piston 701. Thereby, the first hydraulic piston 701 connected to the third link mechanism 600 is driven at a desired speed by the controlled oil pressure.

On the other hand, the second hydraulic operation apparatus 750 comprises the second hydraulic piston 751 and the second hydraulic controller 752. The second hydraulic controller 752 is provided to receive a hydraulic signal from the closing hydraulic valve 705 of the first hydraulic controller 702 through hydraulic piping 801 when the first hydraulic controller 702 receives the closing command.

A detection circuit 800 is provided on the first hydraulic operation apparatus 700 for detecting a final breaking position of the first hydraulic piston 701. The detection circuit 800 issues a hydraulic signal to the second hydraulic controller 752 of the second hydraulic operation apparatus 750 through hydraulic piping 802 when the first hydraulic piston 701 arrives at the predetermined final breaking position of the first hydraulic piston 701. When the second hydraulic operation apparatus 750 receives the hydraulic signal from the detecting circuit 800, the second hydraulic operation apparatus 750 is operated to make the resistor contact 400 break.

Next,the operations of the circuit breaker configured as above in accordance with the present invention is described further referring to FIGS. 7 to 14. The operations of the switching parts provided in the left-hand half part and the right-hand half part are substantially the same. Thus, the operation of the switching part in the left-hand half part only is described as representive, and that in the right-hand half part is omitted.

In the breaking state of the circuit breaker shown in FIG. 2, the first hydraulic piston 701 of the first hydraulic operation apparatus 700 is pressed leftward and the first insulation operation rod 303 is disposed at the lowest position of the linear motion of it. The first lever 314, which is coupled to the first insulation operation rod 303 via the second link 306, is stopped at a position fully rotated clockwise. In such state, the main contact 200, which is coupled to the first lever 314 via the first link 304, is in the breaking state. The third lever 308, which is connected to the first lever 314, is stopped at a position fully rotated counterclockwise.

In FIG. 2, the second hydraulic piston 751 is pressed rightward and the second insulation operation rod 353 is disposed at the lowest position of the linear motion of it. The second lever 318, which is coupled to the second insulation operation rod 353 via the fifth link 324, is stopped at a position fully rotated clockwise. In such state, the resistor contact 400, which is coupled to the second lever 318 via the fourth link 315, is in the breaking state. In the above-mentioned breaking state shown in FIG. 5, the coupling point 318*a* between the second lever 318 and the fourth link 315 is arranged to have a gap against the roller 308*b* of the third lever 308. In the breaking state of the third link mechanism 600 and the fourth link mechanism 650 shown in FIG. 6, the latch 329 contacts the second rod end 655, and the seventh link 331 and the trigger 332 are folded as shown in FIG. 6.

Figure 7:
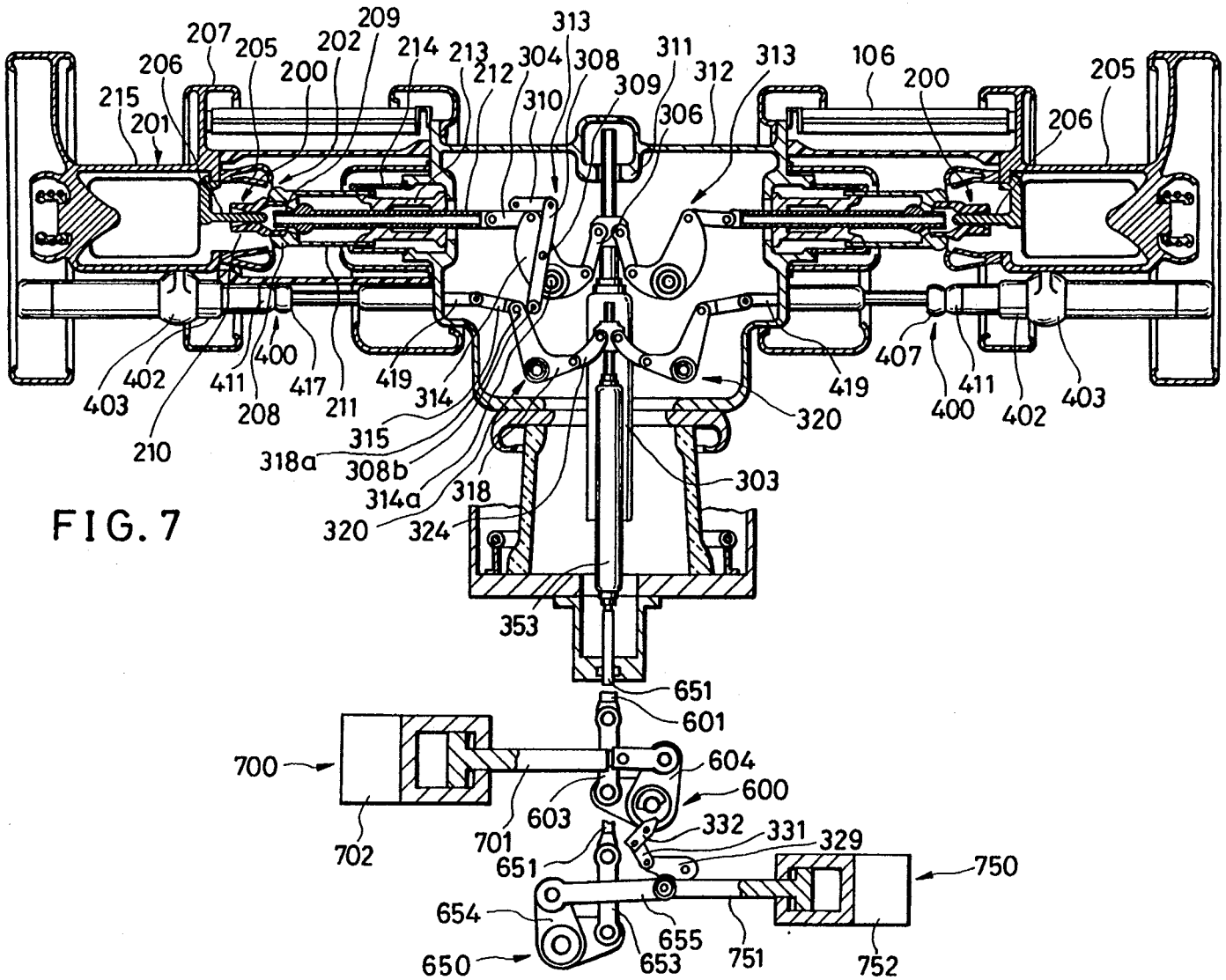
FIG. 7 is a sectional side view showing the switching part of the circuit breaker and the manner of the closing operation thereof.

When a closing command is issued from the external control apparatus (which is not shown in the figures), the closing electric magnet 703 of the first hydraulic controller 702 shown in FIG. 6 is operated, and thereby the closing hydraulic vale 705 is opened and the hydraulic signal of the first hydraulic controller 702 is transmitted to the second hydraulic controller 752 through the hydraulic piping 801 at the same time. As a result, the first hydraulic piston 701 and the first rod end 605 are moved rightward in FIG. 6. When the first rod end 605 is moved rightward, the third lever 604 is rotated clockwise. Thereby, the first shaft 601 is moved upward via the sixth link 603. Furthermore, the first insulation operation rod 303, which is connected to the above-mentioned first shaft 601, is moved upward as shown in FIG. 7. The first lever 314, which is coupled with the first insulation operation rod 303 via the second link 306, is rotated in the counterclockwise direction. In addition, the puffer cylinder 211 of the moving electrode 202 is driven so as to make the main contact 200 close by the movement of the first lever 314, via the first link 304 and the piston rod 212.

At the same time, the second hydraulic piston 751 and the second rod end 655 are moved in a leftward direction of FIG. 6. When the second rod end 655 is moved leftward, the fourth lever 654 is rotated in the counterclockwise direction. Thereby, the second shaft 651 is moved upward via the eighth link 653. Furthermore, the second insulation operation rod 353, which is connected to the above-mentioned second shaft 651, is moved upward as shown in FIG. 7. The second lever 318, which is coupled with the second insulation operation rod 353 via the fifth link 324, is rotated counterclockwise. And, the moving resistor contact 417 of the resistor contact 400 is moved to contact the stationary resistor contact 401 by the movement of the second lever 318 via the fourth link 315 and the rod 419.

On the other hand, the third lever 308, which is coupled to the first lever 314 by the pin 309, is rotated around the coupling point of the third link 310 and the third lever 308 clockwise by rotating the first lever 314 counterclockwise as shown in FIG. 7. When the third lever 308 is rotated clockwise, the roller 308*b*, which is provided at bottom end of the third lever 308, abuts the coupling point 318*a* between the fourth link 315 and the second lever 318. In the above-mentioned abutting state between the roller 308*a* and the coupling point 318*a*, when the second lever 318 is rotated counterclockwise by the second hydraulic operation apparatus 750, the moving resistor contact 417 of the resistor contact 400 is driven to close the stationary resistor contact 401 via the fourth link 315 and the rod 419.

The closing speed of the resistor contact 400 operated by the second hydraulic piston 751 is previously adjusted at the lower speed than the closing speed of the main contact 200 operated by the first hydraulic piston 701. As a result, in the above-mentioned closing operation of the resistor contact 400, the moving resistor contact 417 is moved to close the stationary resistor contact 411 with the closing operation of the main moving contact 208 in a manner such that the roller 308*b* of the third lever 308 is kept to contact with the coupling point 318*a* of the second lever 318 and the fourth link 315.

As shown in FIG. 7, at first, the moving resistor contact 417 contacts the stationary resistor contact 411 before the moving arc contact 209 contacts the stationary arc contact 206, and thereby only the resistor contact 400 is in a closed state. As a result, the resistors 508 is electrically connected in series with the resistor contact 400 for reducing the surge which occurs in the closing operation. Furthermore, the moving resistor contact 417 pushes the stationary resistor contact 411 in the resistor contact case 402 and compresses the restoration spring 404 (FIG. 4). Following this operation, the moving arc contact 209 is closed to the stationary arc contact 206 and the main moving contact 208 is closed to the main stationary contact 205, serially.

When the stationary resistor contact 411 of the resistor contact 400 shown in FIG. 4 is pushed into the resistor contact case 402 by the moving resistor contact 417, the insulation gas ($SF_6$ gas) 102 in a space formed between the piston 405 and the stationary resistor contact 411 is compressed. When the compressed insulation gas 102 is exhausted from the orifices 406, the resistance force between the insulation gas 102 and the orifices 406 serves as a damping force.

Figure 8:
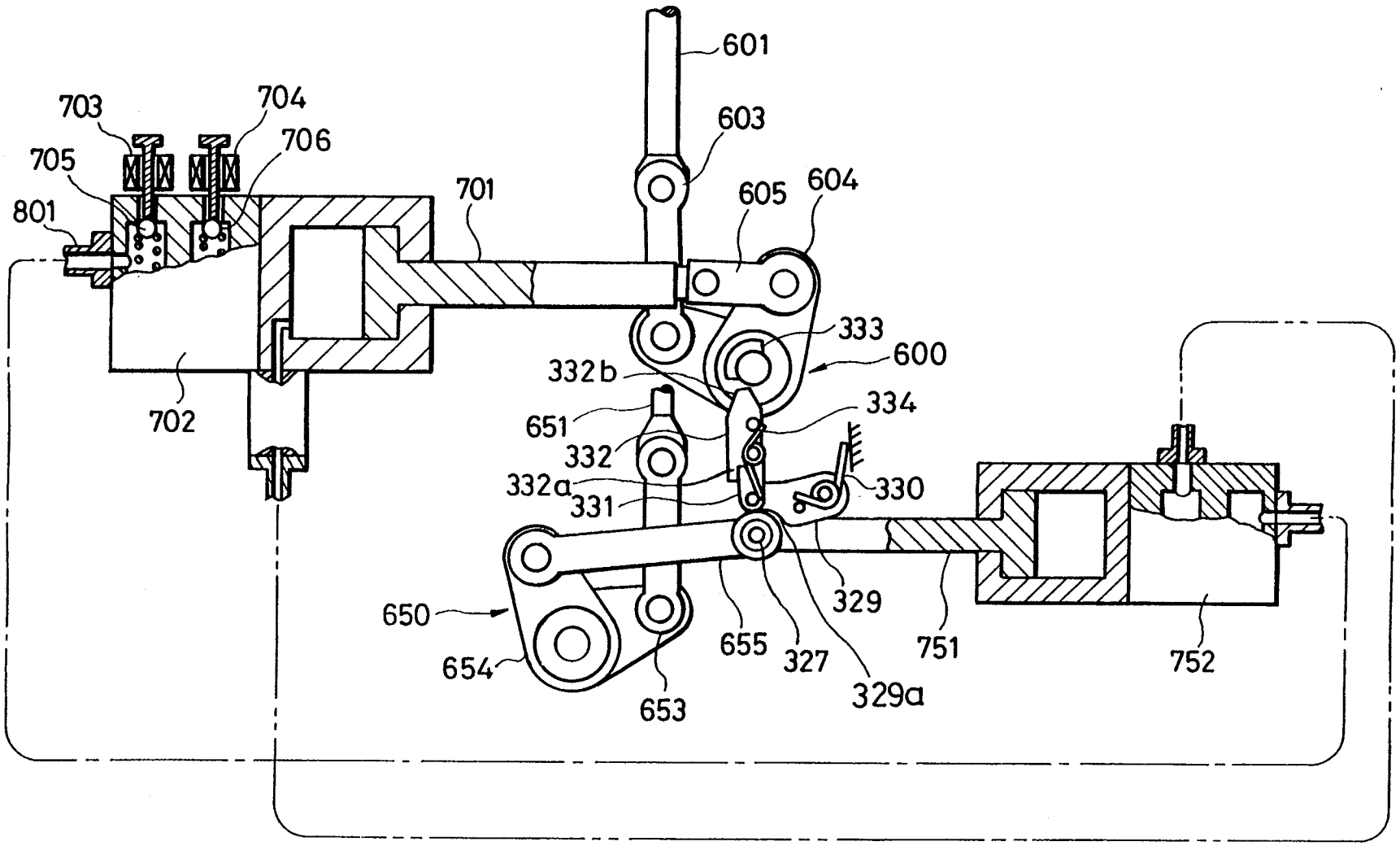
FIG. 8 is a sectional side view showing the third link mechanism and the fourth link mechanism of the circuit breaker In the closing state.

FIG. 8 is a side view showing the third link mechanism 600 and the fourth link mechanism 650 of the circuit breaker in the closed state. As shown in FIG. 8, a roller 327, which is provided between the second hydraulic piston 751 and the second rod end 655, is moved leftward by the closing operation of the second hydraulic piston 751. When the roller 327 reaches the final position of the closing operation, the latch 329, which was slidably guided by the second rod end 655, is rotated to thereby engage with the roller 327 by the rotation force of the restoration spring 330 in the counterclockwise direction. The contact part 332*b* of the trigger 332 is released from the cam 333 owing to the rotation of the third lever 604 in a clockwise direction. Following the above-mentioned motions of the third lever 604, the trigger 332 and the seventh link 331, which is coupled to the latch 329, are extended straight by the force of the restoration spring 334, in a manner such that the stopper 332*a* of the trigger 332 contacts the seventh link 331.

Figure 9:
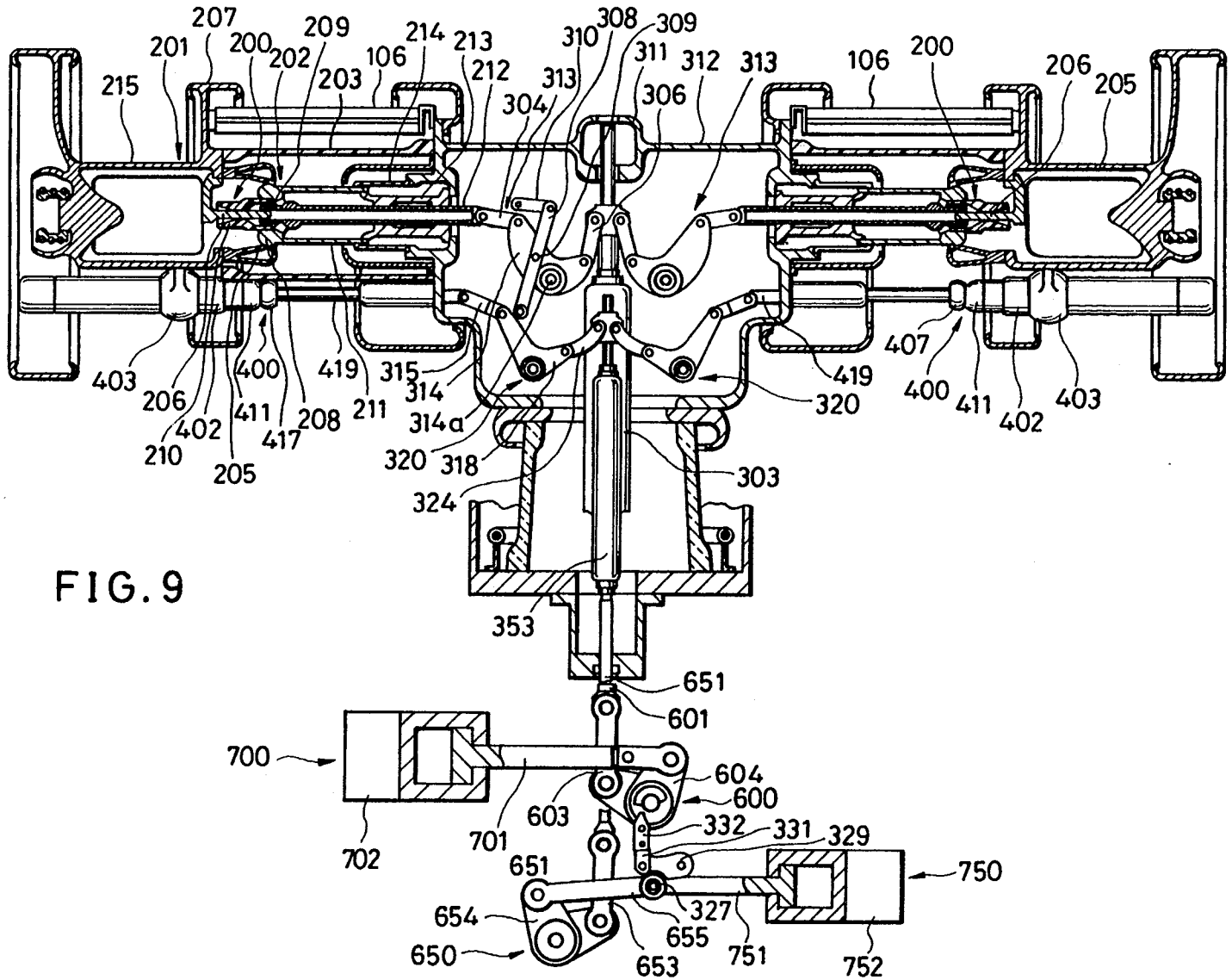
FIG. 9 is a sectional side view showing the switching part of the circuit breaker in the closing state.

FIG. 9 is a sectional side view showing the closed state of the switching part of the above-mentioned circuit breaker. When the first hydraulic piston 701 reaches the final position shown in FIG. 9, the closing operation of the circuit breaker has been completed. In the closed state shown in FIG. 8, the roller 327 is disposed so as to have a gap against the coupling part 329*a*.

Next, the breaking operation of the circuit breaker is described. In the closed state of the circuit breaker shown in FIGS. 8 and 9, when a breaking command is issued from the external control apparatus (which is not shown in the figure), the breaking hydraulic valve 706 (FIG. 8) is opened by exciting the breaking electric magnet 704 of the first hydraulic controller 702. In addition, an amplified hydraulic signal from the first hydraulic controller 702 is transmitted to the first hydraulic piston 701. As a result, the first hydraulic piston 701 and the first rod end 605 starts to move leftward of FIG. 8. The third lever 604 rotates counterclockwise, and the first shaft 601 is moved downward by the rotation of the third lever 604 via the sixth link 603. Furthermore, the first insulation operation rod 303 is also moved downward. In FIG. 9, the first lever 314, which is coupled to the first insulation operation rod 303 via the second link 306, is rotated clockwise. The puffer cylinder 211 of the moving electrode 202 slides toward the center of the frame conductor 312, being operated by the first lever 314 via the first link 304 and the piston rod 212.

Figure 10:
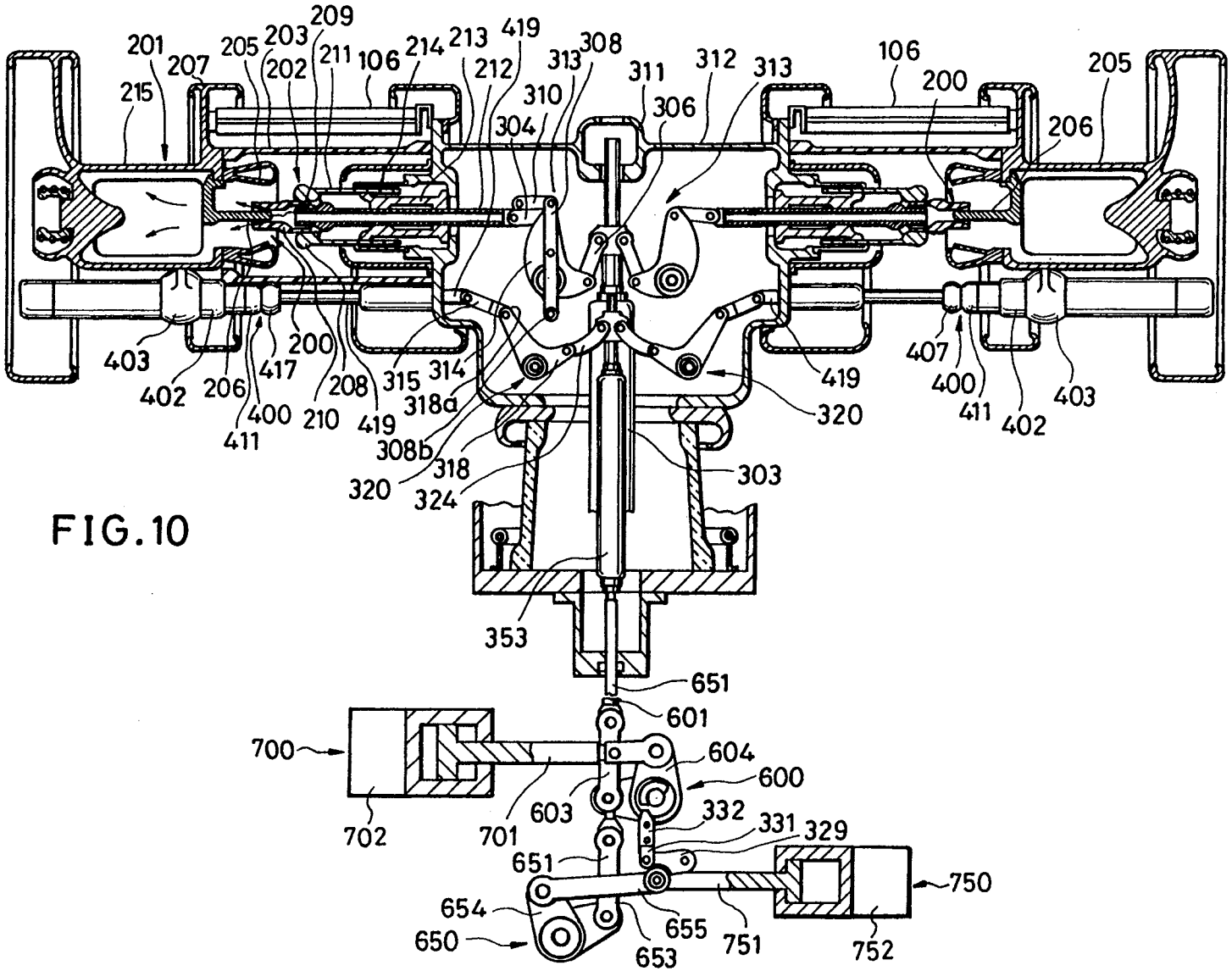
FIG. 10 is a sectional side view showing the switching part of the circuit breaker in an initial state of the breaking operation.

On the other hand, when the first lever 314 is rotated clockwise, the third lever 308, which is coupled to the first lever 314 by the pin 309, is rotated counterclockwise around the coupling point between the third link 310 and the third lever 308 as shown in FIG. 10. FIG. 10 is a side view showing of the circuit breaker in the breaking operation. As shown in FIG. 10, the roller 308*b* which is provided at bottom end of the third lever 308, is moved in a rightward direction so as to depart from the coupling point 318*a*. Since the second lever 318, which is coupled with the moving resistor contact 417, is kept to receive the strong counterclockwise force from the second hydraulic piston 751 in the above-mentioned state shown in FIG. 10, the second lever 318 does not move and stays at the same position as the final position of the closed state. Therefore, the resistor contact 400 is kept in the closed state.

In FIG. 10, by the clockwise rotation of the first lever 314, the main moving contact 208 of the main contact 200 departs from the main stationary contact 205. After that, the moving arc contact 209 departs from the stationary arc contact 206. At the breaking time shown in FIG. 10, an arc occurs between the moving arc contact 209 and the stationary arc contact 206.

Figure 11:
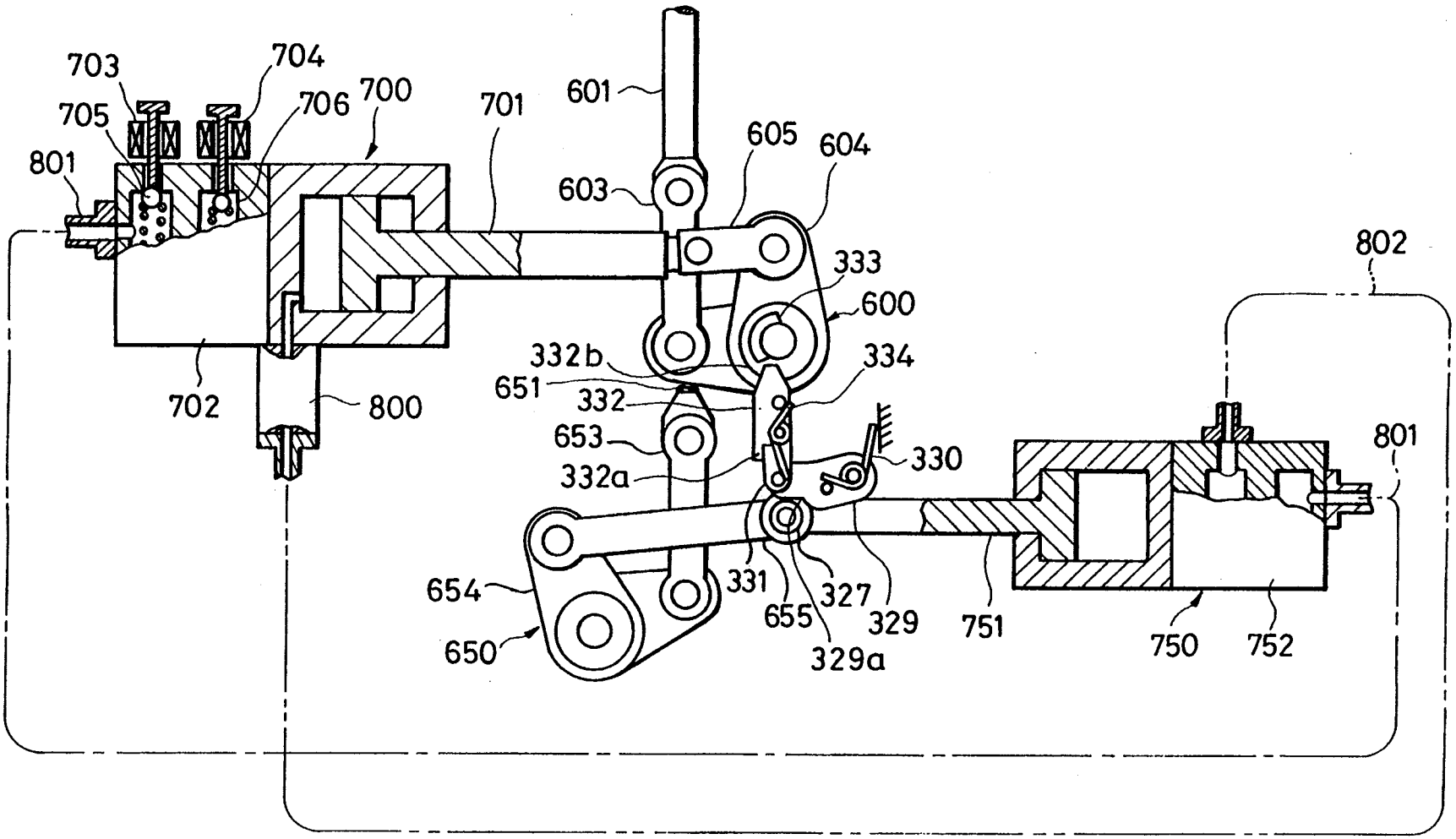
FIG. 11 is a side view showing the third link mechanism and the fourth link mechanism of the circuit breaker in the initial state of the breaking operation.

When the insulation gas 102, which is compressed by the piston 213 and the puffer cylinder 211, blows the arc, the current flowing the main contact 200 is cut off thereby and a limited current flows through the resistor contact 400 and resistors 508. By using the resistors 508, an overvoltage at the breaking time is reduced to a desired voltage. FIG. 11 shows the third link mechanism 600 and the fourth link mechanism 650 of the circuit breaker shown in FIG. 10.

Figure 12:
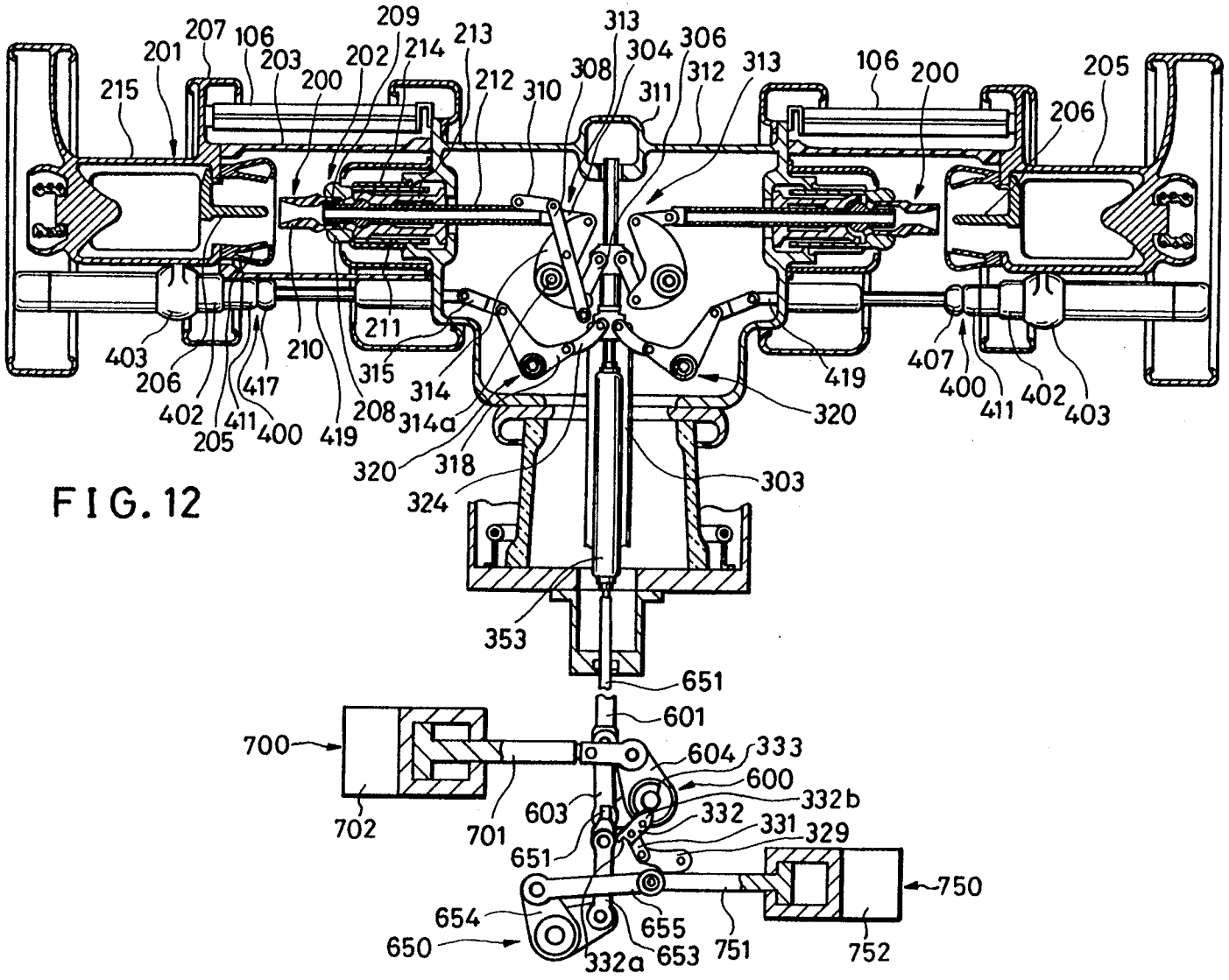
FIG. 12 is a sectional side view showing the switching part of the circuit breaker and the manner of the breaking operation thereof.

FIG. 12 is a sectional side view showing the switching part of the circuit breaker in the breaking operation. In FIG. 12, when the first hydraulic piston 701 reaches the final breaking position, the breaking operation for the main contact 200 has been completed. In the above-mentioned state shown in FIG. 12, the first lever 314 and the third lever 308 are disposed at the final breaking position.

When the fifth lever 604 operated by the first hydraulic piston 701 is further rotated counterclockwise beyond the position at the above-mentioned breaking time shown in FIG. 11 and approaches the final position of the breaking operation, the cam 333 on the fifth lever 604 pushes the contact part 332*b* of the trigger 332 and the trigger 332 starts to rotate in the clockwise direction as shown in FIG. 12. Therefore, the stopper part 332*a* of the trigger 332 departs from the seventh link 331, and the trigger 332 and the seventh link 331 are folded against the force of the restoration spring 334. As a result, the latch 329 is released from the restraint brought by the seventh link 331 and the trigger 332, and the latch 329 starts to rotate clockwise so as to release from the roller 327.

In the above-mentioned breaking operation shown in FIG. 11, when the first hydraulic piston 701 of the first hydraulic operation apparatus 700 is moved leftward, and reaches the final breaking position as shown in FIG. 12, such state is detected by the detection circuit 800. The detection circuit 800 issues a hydraulic signal to the second hydraulic controller 752 of the second hydraulic operation apparatus 750 via the hydraulic piping 802. As a result, the second hydraulic piston 751 starts to move rightward so as to break the resistor contact 400.

Figure 13:
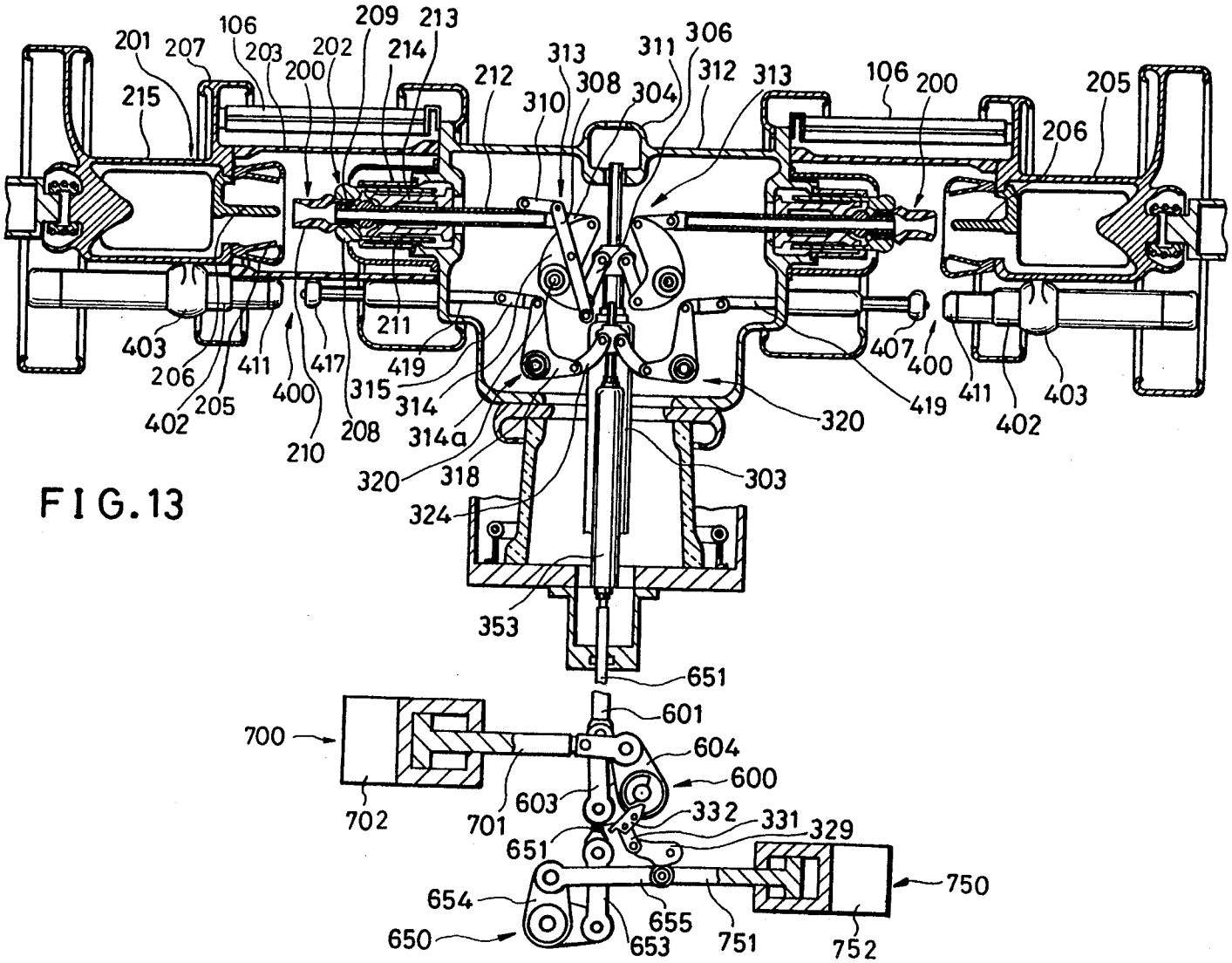
FIG. 13 is a sectional side view showing the switching part of the circuit breaker and the manner of the breaking operation thereof.

In the above-mentioned breaking operation, the second hydraulic piston 751 and the second rod end 655 start to move rightward in FIG. 12. And the second shaft 651 is moved downward by the rotation of the fourth lever 654 in the clockwise direction via the eighth link 653. Furthermore, the second insulation operation rod 353, which is connected to the second shaft 651, is moved downward as shown in FIG. 13. FIG. 13 shows the switching part that the resistor contact 400 is in the way of the breaking operation. The second lever 318, which is coupled with the second insulation operation rod 353 via the fifth link 324 is rotated clockwise. The moving resistor contact 417 of the resistor contact 400 is moved to the center of the frame conductor 312 via the fourth link 315 and the rod 419.

After the above-mentioned breaking operation shown by FIG. 13, the circuit breaker is in the initial state of the opened circuit breaker shown by FIG. 2.

Next, an interlock mechanism of the above-mentioned circuit breaker in accordance with the present invention is described.

In the above-mentioned breaking operation, the breaking speed of the main contact 200 and the resistor contact 400 must be set faster than the closing speed of them in order to secure necessary dielectric strength after current cut-off. Therefore, the drive unit which produces a large driving force for the main contact 200 and the resistor contact 400 must be provided in the circuit breaker. In addition, the circuit breaker needs the countermeasure for the malfunction owing to a mechanical shock or a vibration which is produced by such drive unit. The aforementioned circuit breaker of the present invention has the following interlock mechanism in order to prevent the malfunctioning.

In the closed state of the circuit breaker shown in FIG. 9, when a breaking command is issued from the external control apparatus (which is not shown in the figure), the first hydraulic piston 701 starts so as to break the main contact 200. Let us suppose that in the the breaking operation of the main contact 200, the second hydraulic controller 752 of the second hydraulic operation apparatus 750 has been malfunctioned due to a shock or a vibration or the like of the first hydraulic piston 701, and the second hydraulic piston 751 receives a driving force rightward in FIG. 9.

Figure 14:
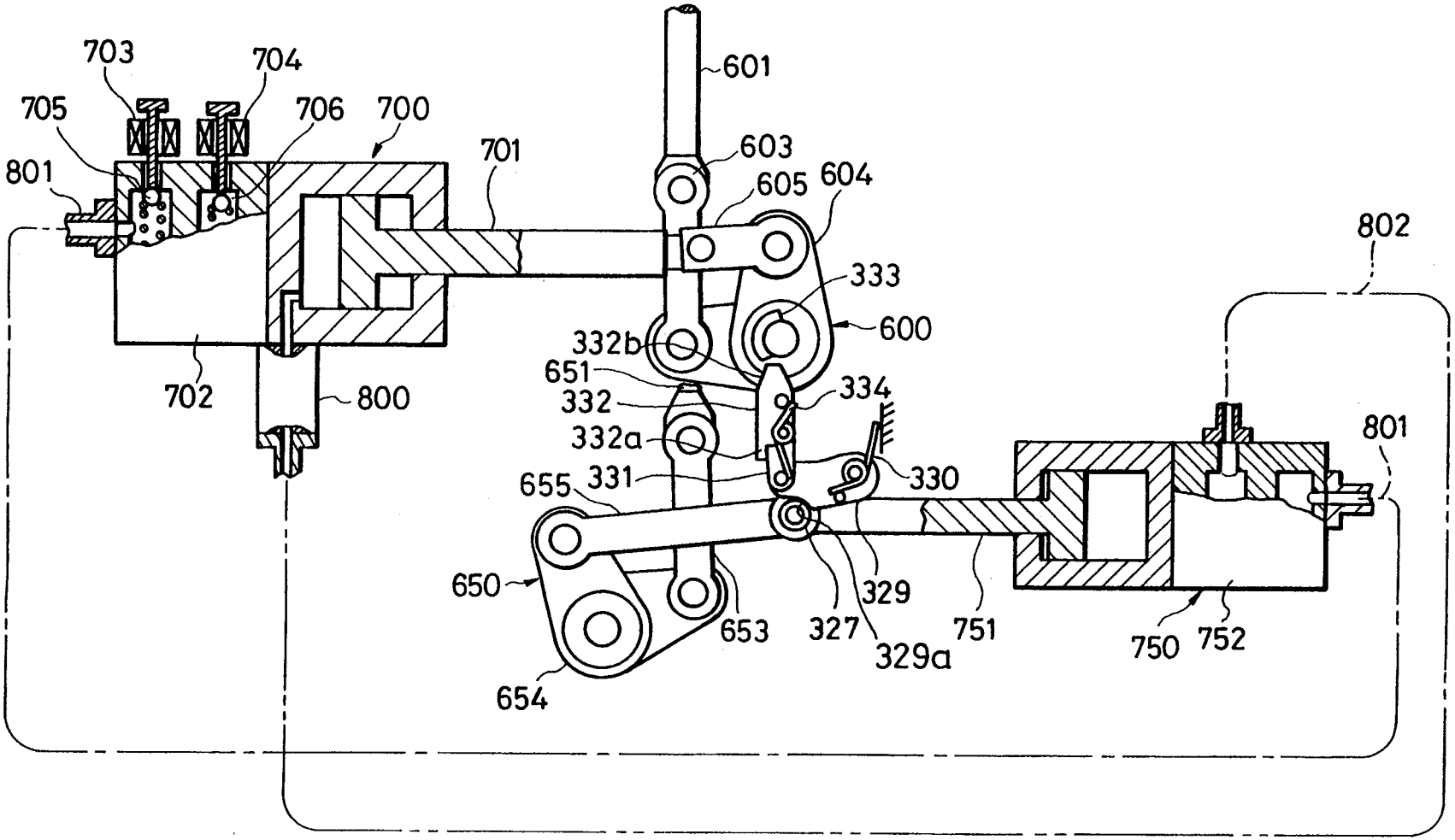
FIG. 14 is a side view showing the third link mechanism and the fourth link mechanism when a second hydraulic operation apparatus is moved by an undesired operation.

Then, the second hydraulic piston 751 starts to further move rightward. FIG. 14 shows the above-mentioned state that the second hydraulic piston 751 is operated in the malfunctioning. In the above-mentioned malfunction of the second hydraulic piston 751, the second hydraulic piston 751 and the second rod end 655 start to move rightward. When the second hydraulic piston 751 and the second rod end 655 is moved for a very short interval, the roller 327 abuts the coupling part 329*a* of the latch 329. Therefore, the latch 329 receives a revolution force in the clockwise direction against the force of the restoration spring 330, and the seventh link 331 receives a lifting force in an upward direction. As a result, though the trigger 332 receives a revolution force in the counterclockwise direction, the trigger 332 is prevented from rotating by contacting between the stopper 332*a* of the trigger 332 and the seventh link 331.

By the above-mentioned engagement between the roller 327 and the coupling part 329*a* of the latch 329, the second lever 318, the fourth link 315, the rod 419 and the moving resistor contact 417, which are mechanically connected to the second hydraulic piston 751, are prevented from experiencing malfunctional motion owing to a shock, a vibration or the like. As a result, the resistor contact 400 is kept safely in the closed state even if the second hydraulic operation apparatus 750 malfunctions.

When the main contact 200 approaches the final step of the breaking operation, the cam 333, which is provided on the third lever 604, pushes the contact part 332*b* of the trigger 332, and thereby, the trigger 332 is rotated clockwise as shown in FIG. 12. As a result, the stopper part 332*a* of the trigger 332 departs from the seventh link 331, and the trigger 332 and the seventh link 331 are folded against the force of the restoration spring 334. Therefore, the latch 329 is released from the restraint of the seventh link 331 and the latch 329 starts clockwise rotation. In addition, the engagement of the latch 329 and the roller 327 is also released. Since the roller 327 becomes free from the restraint of the latch 329, the second hydraulic piston 751 and the second rod end 655 start to move rightward, to thereby break the resistor contact 400 by the driving force of the second hydraulic operation apparatus 750. Then, the fourth lever 654 rotates clockwise, and the second shaft 651 is moved downward by the rotation of the fourth lever 654 via the eighth link 653. In addition, the second insulation operation rod 353 is also moved downward. As a result, the second lever 318, which is coupled to the second insulation operation rod 353 via the fifth link 324, is rotated clockwise as shown in FIG. 13. The moving resistor contact 417 of the resistor contact 400 is moved toward the center of the frame conductor 312 by the rotation of the second lever 318 via the fourth link 315 and rod 419.

As the interlock mechanism is constructed by the above-mentioned mechanism, the breaking timing between the main contact 200 and the resistor contact 400 is kept constant even if a mechanical shocks or the vibration occurs in the breaking operation.

On the other hand, in the closing operation of the circuit breaker, the first hydraulic piston 701 and the second hydraulic piston 751 start to move in a closing direction at the same time when a closing command is received. The resistor contact 400 operated by the second hydraulic piston 751 is driven so as to be closed with a lower speed than the closing speed of the main contact 200 operated by the first hydraulic piston 701. Therefore, in the closing operation, the roller 308*b* of the third lever 308 keeps in contact with the coupling point 318*a* between the fourth lever 315 and the second lever 318. In such state, the moving resistor contact 417 is moved leftward to approach to the stationary resistor contactor 411 at the same speed as the main contact 200. As a result, the closing timing between the resistor contact 400 and the main contact 200 is kept constant in the closing operation.

Figure 15A:
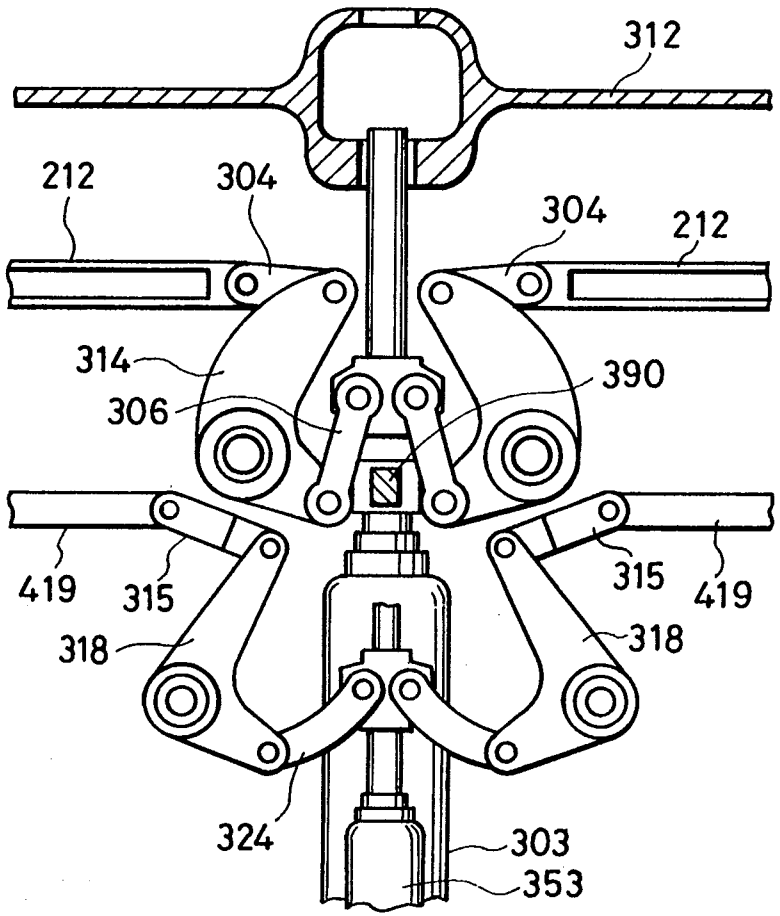
FIG. 15(*a*) is a side view showing an engagement mechanism of a circuit breaker of a second embodiment in accordance with the present invention.
Figure 15B:
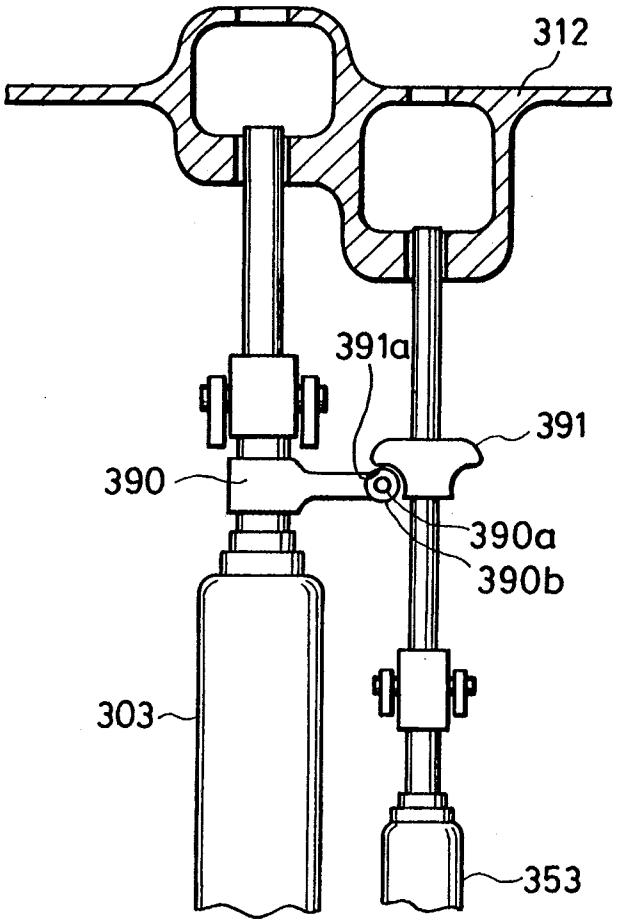

Hereafter, a second embodiment of a circuit breaker in accordance with the present invention is described referring to the accompanying drawings of FIGS. 15(*a*) and 15(*b*).

FIG. 15(*a*) is a side view of an engagement mechanism in a circuit breaker of the second embodiment in accordance with the present invention. FIG. 15(*b*) is a front view of the engagement mechanism of FIG. 15(*a*).

Corresponding parts and components to the first embodiment are indicated by the same numerals and marks, and the description thereof made in the first embodiment similarly apply. The differences and added features of this second embodiment as compared with the first embodiment are as follows.

In the circuit breaker of the aforementioned first embodiment shown in FIG. 5, the engagement mechanism between the main contact 200 and the resistor contact 400 comprises the third link 310, which is rotatably provided on the frame conductor 312, and the third lever 308 which is rotatably supported by the first lever 314. In addition roller 308*b* of the third lever 308 in the first embodiment is arranged to contact with the coupling point 318*a* between the fourth link 315 and the second lever 318 in the closing operation.

In the circuit breaker of the second embodiment shown in FIGS. 15(*a*) and 15(*b*), the first insulation operation rod 303 for operating the main contact 200 has a pusher 390 for linking the second insulation operation rod 353 for operating the resistor contact 400. The second insulation operation rod 353 has a receiver 391 which is provided to contact to a roller 390*b* of the pusher 390. The roller 390*b* is rotatably supported by a pin 390*a* on the project end of the pusher 390. When the main moving contact and the moving resistor contact are moved in closing directions (as shown in FIG. 2), the roller 390*b* engages with the receiver 391. Since the receiver 391 is arranged to be contacted at the downward face 391*a* of the receiver 391, the engagement mechanism comprising the pusher 390 and the receiver 391 has the same effect as the aforementioned engagement mechanism in the first embodiment having the third link 310 and the third lever 308.

According to the above-mentioned circuit breaker of the second embodiment, the engagement mechanism is moved by using the linearly movement of the insulation operation rods 303 and 353 up and down. As a result, the engagement mechanism of the second embodiment can be constructed with fewer parts than the circuit breaker of the first embodiment.

Figure 16A:
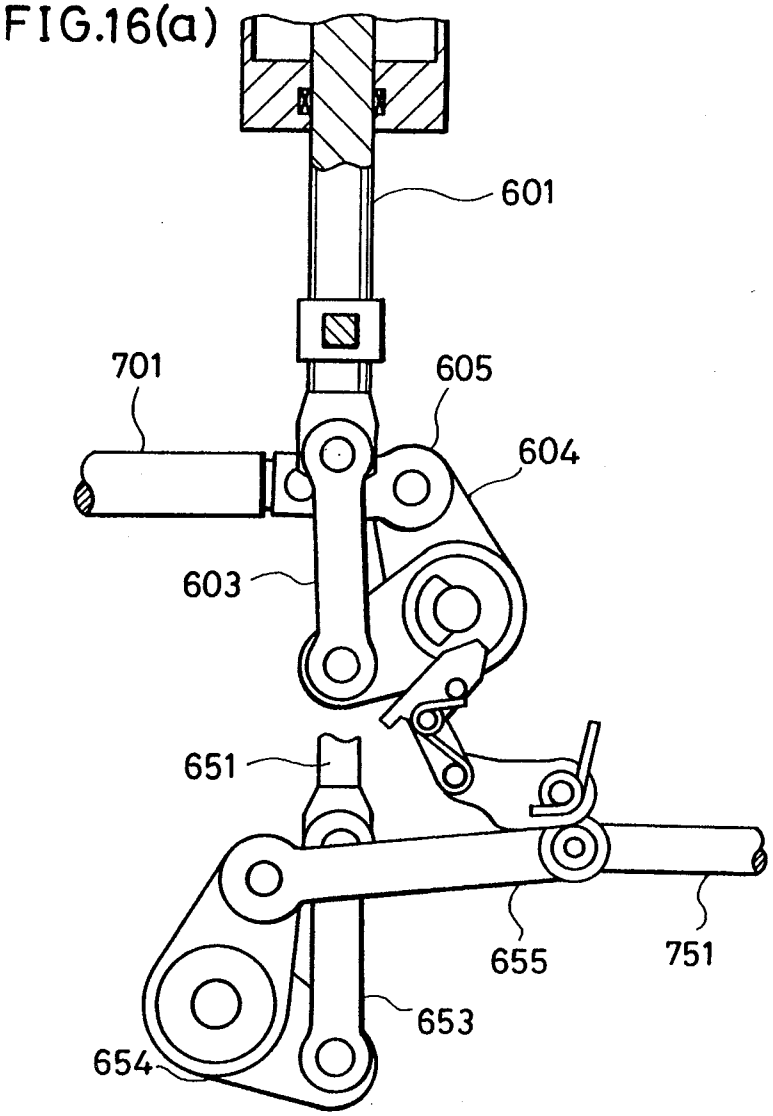
FIG. 16(*a*) is a side view showing an engagement mechanism of a circuit breaker of a third embodiment in accordance with the present invention.
Figure 16B:
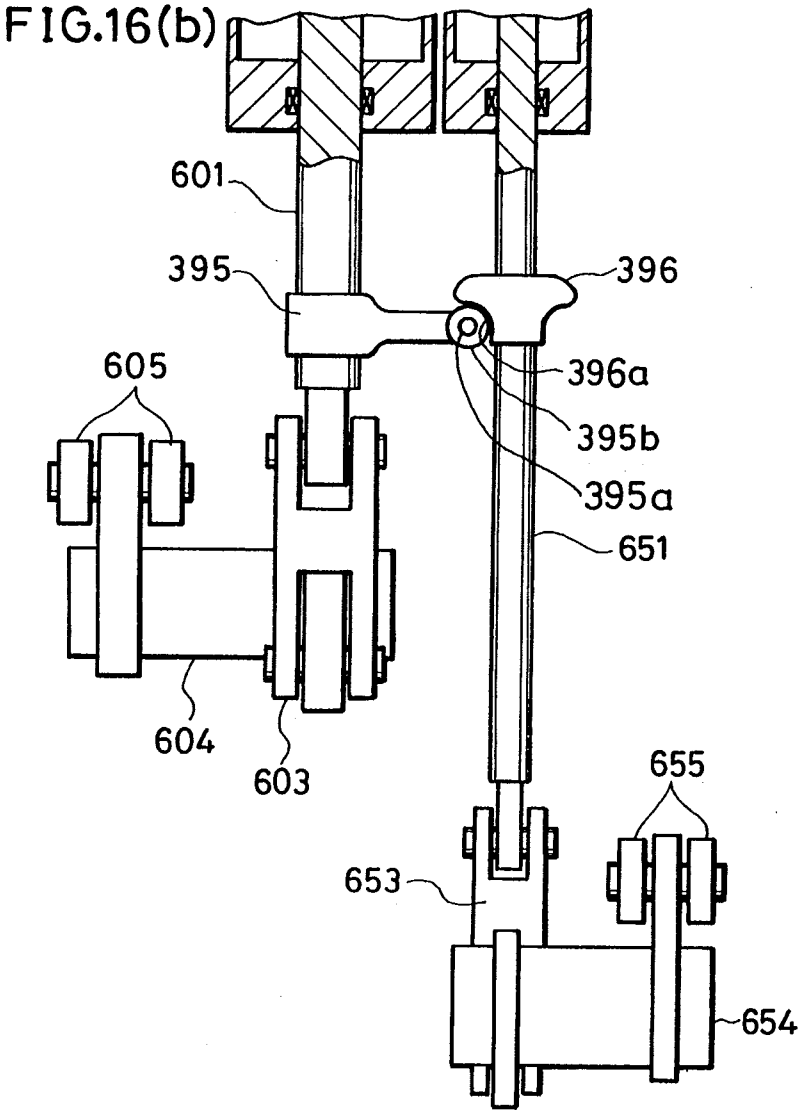
Figure 17:
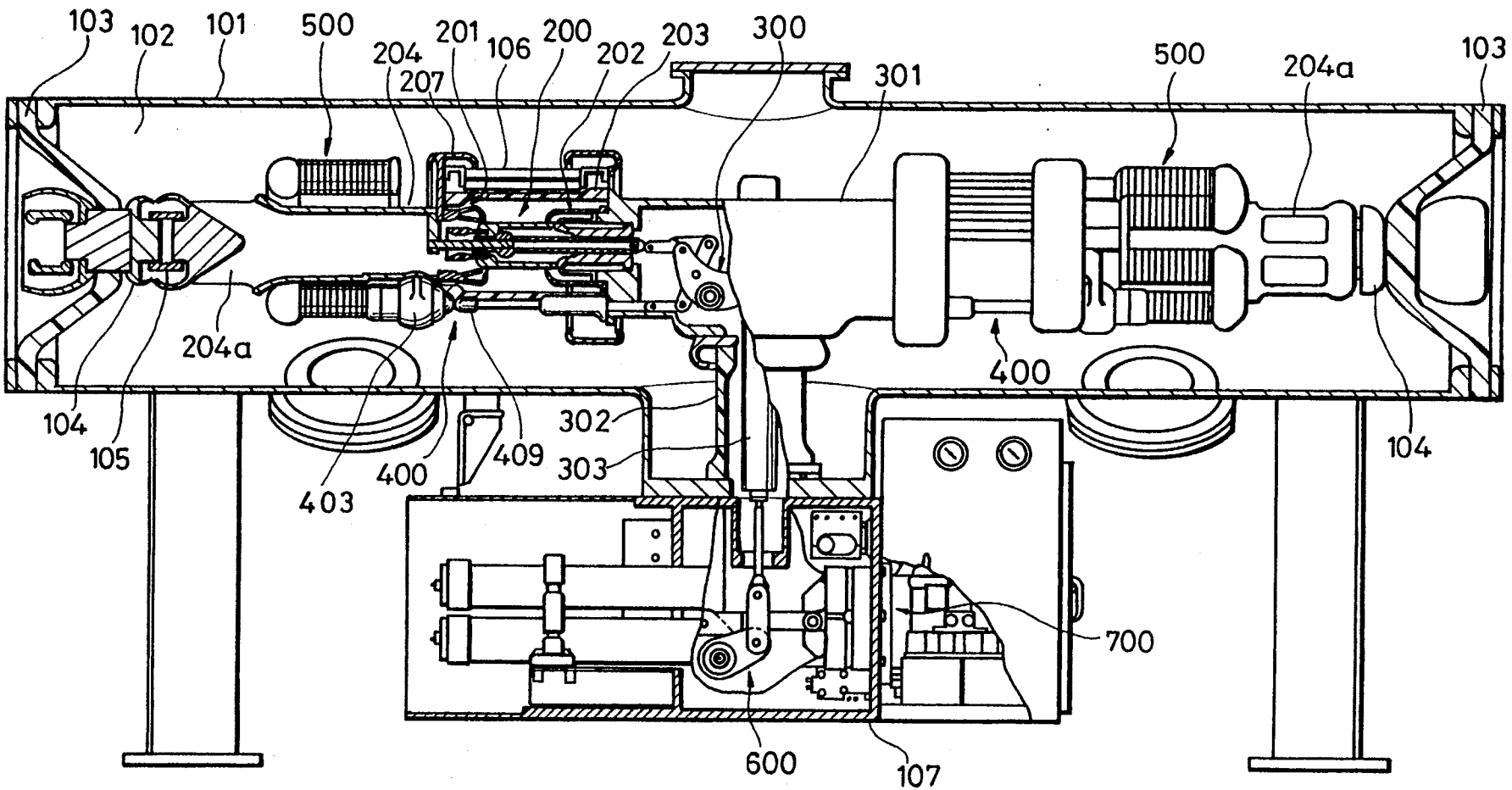
FIG. 17 (Prior Art)
FIG. 17 is the sectional side view showing the constitution of the conventional circuit breaker.
Figure 18:
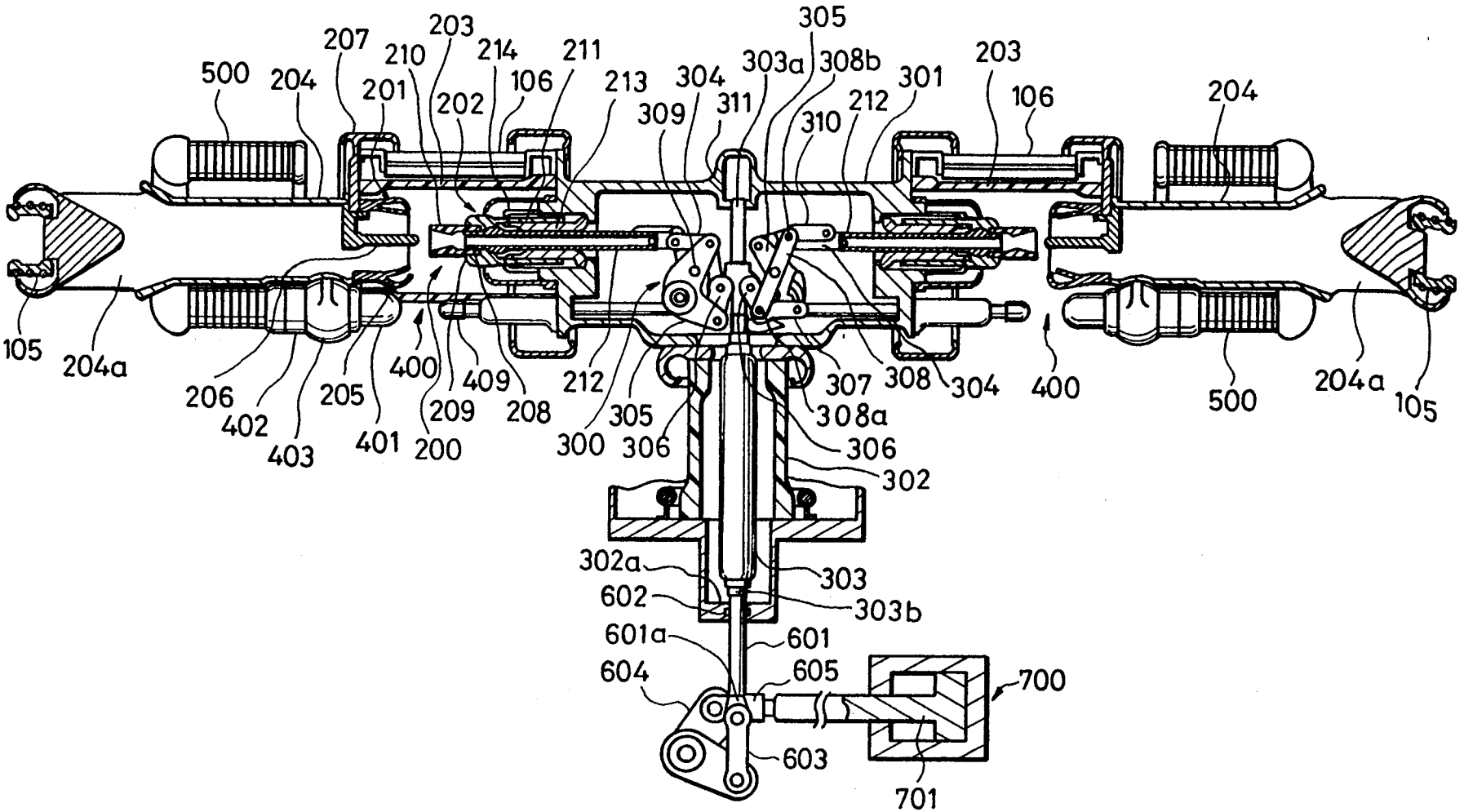
FIG. 18 (Prior Art)
FIG. 18 is the sectional side view showing the detailed constitution of the switching part of the conventional circuit breaker.
Figure 19:
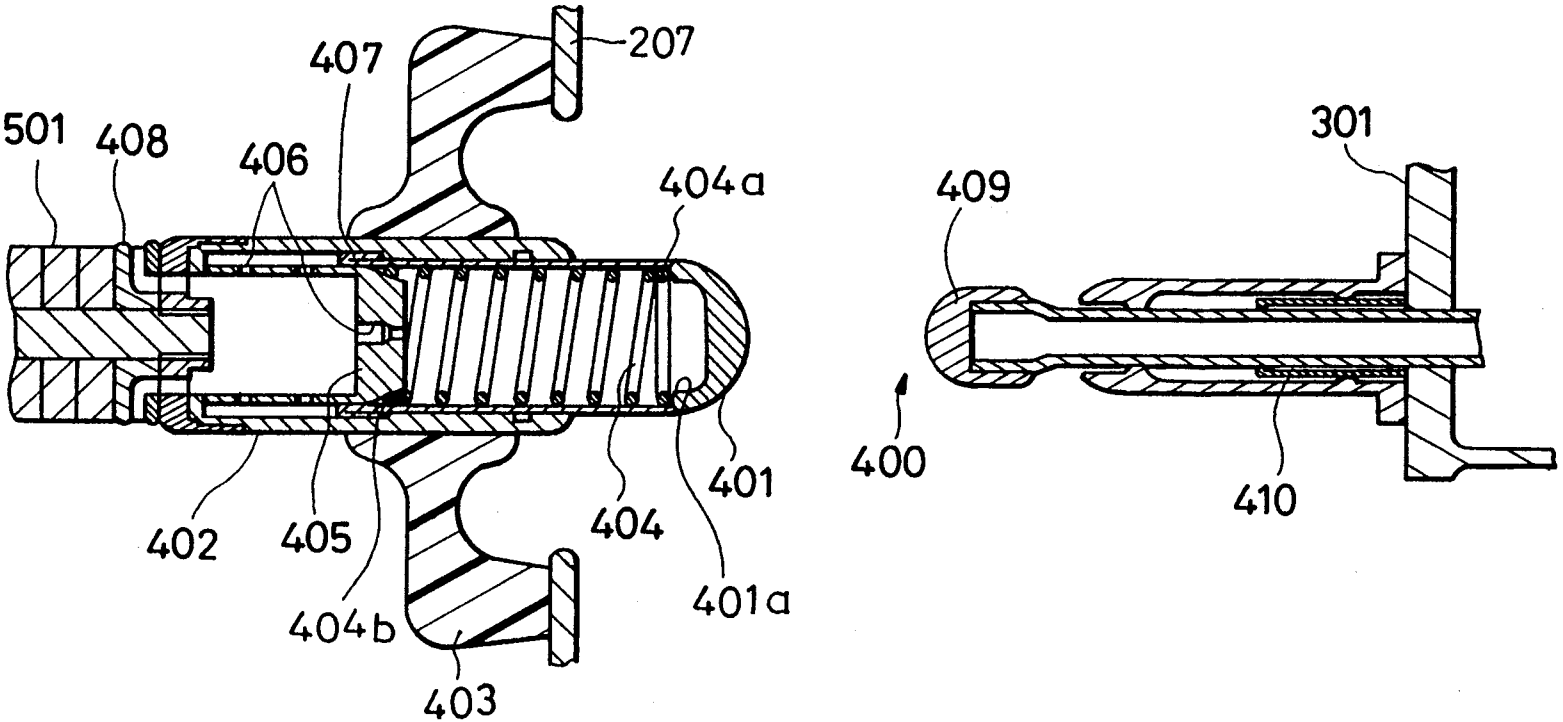
FIG. 19 (Prior Art)
FIG. 19 is the sectional side view showing the detailed constitution of the resistor contact of the conventional circuit breaker.
Figure 20:
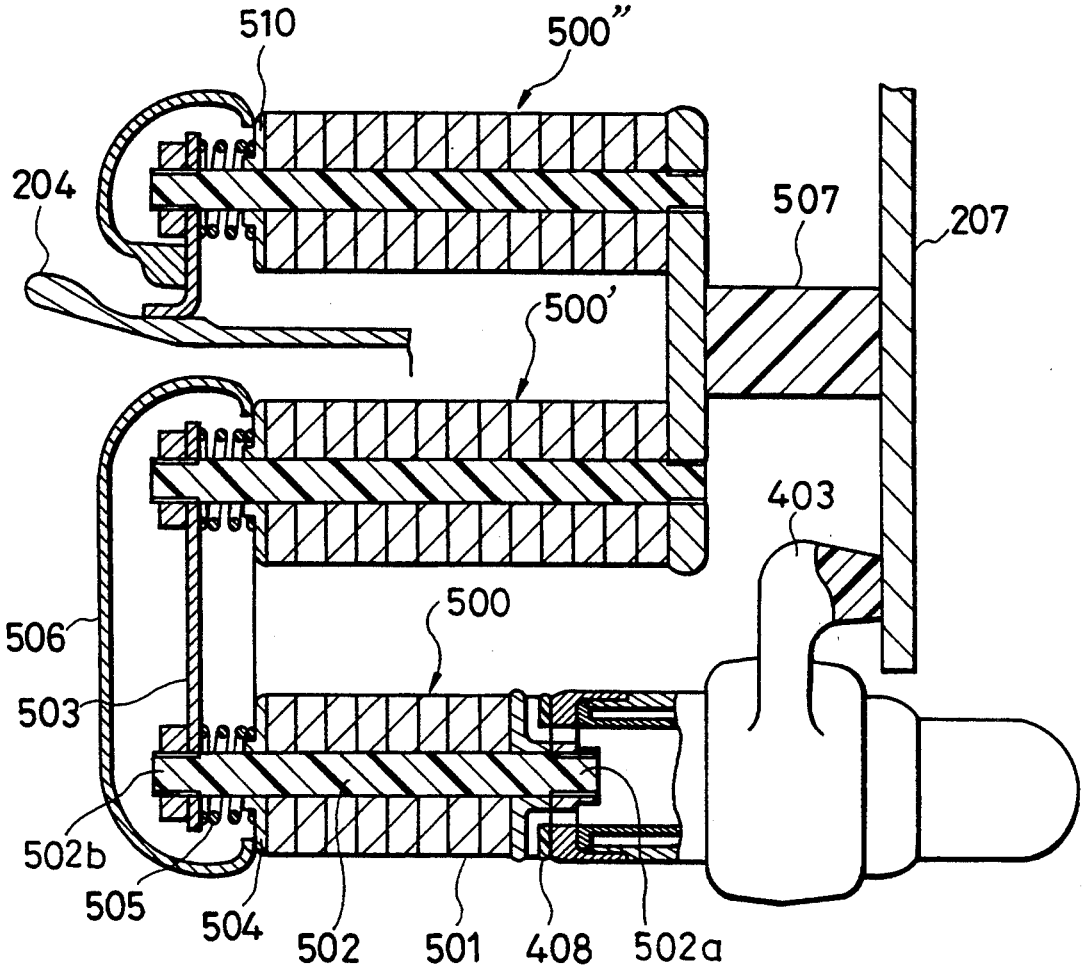
FIG. 20 (Prior Art)
FIG. 20 is the sectional side view showing the detailed constitution of the resistor of the conventional circuit breaker.
Figure 21:
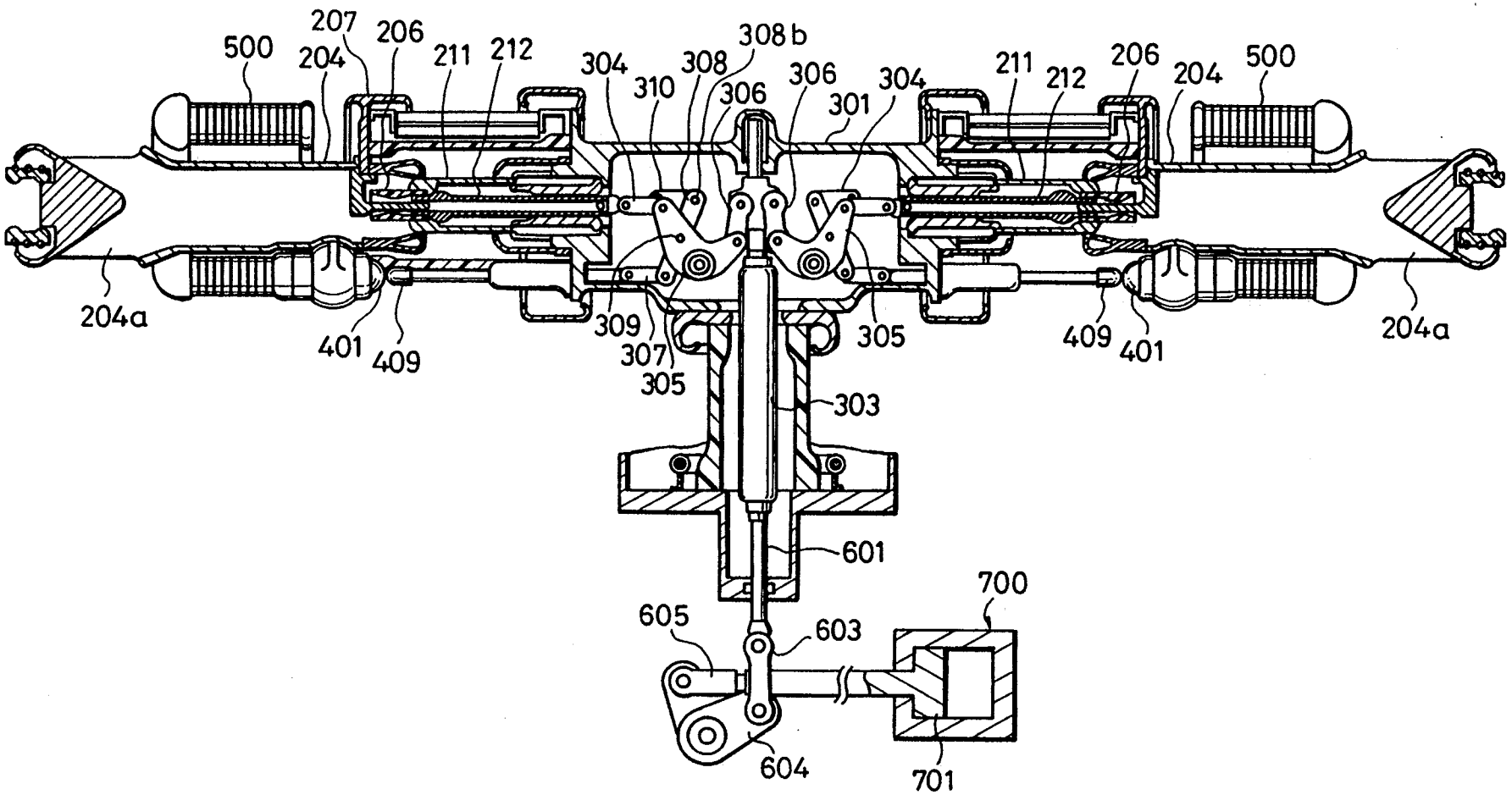
FIG. 21 (Prior Art)
FIG. 21 is the sectional side view showing the switching part of the conventional circuit breaker in the closed state.
Figure 22:
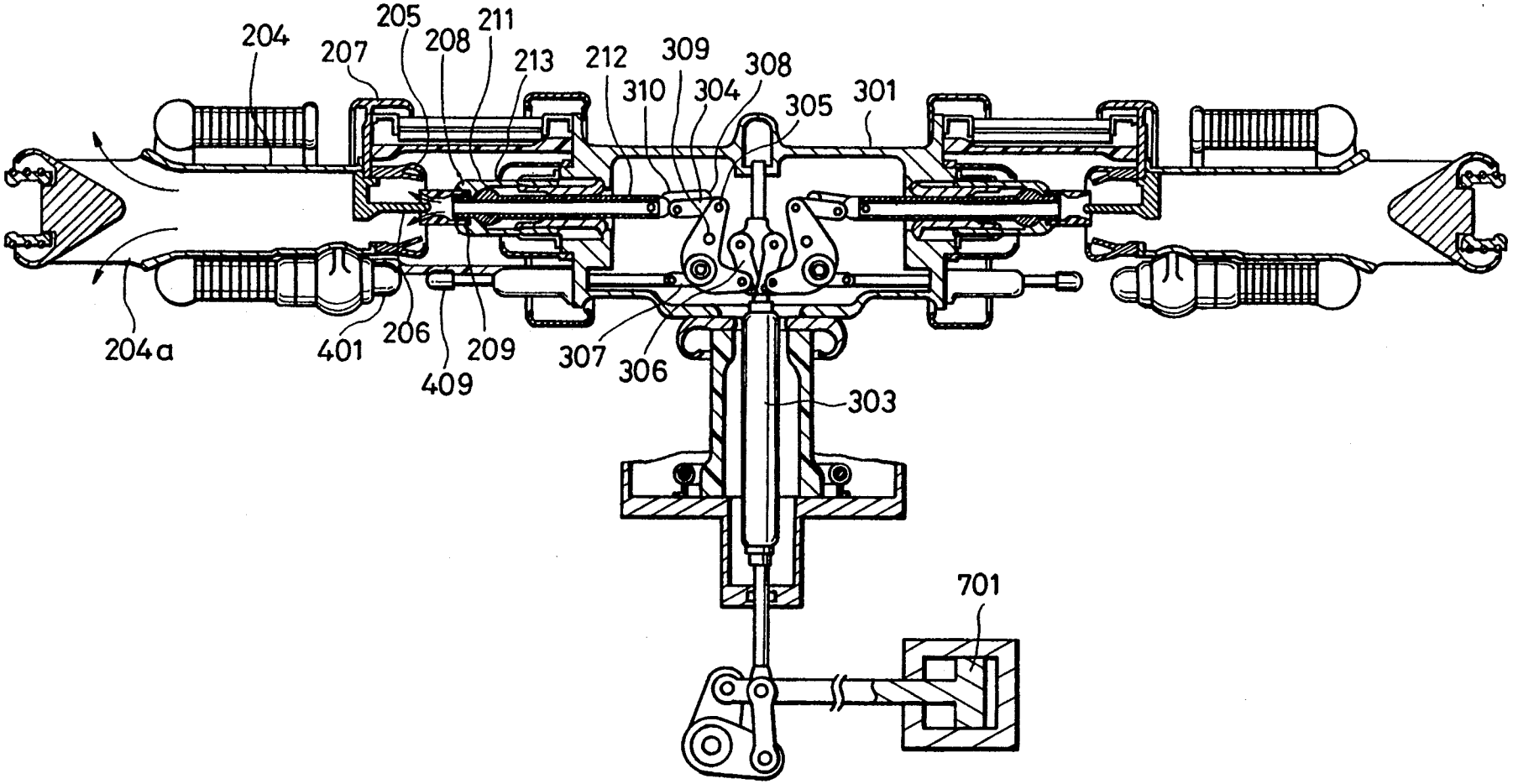
FIG. 22 (Prior Art)
FIG. 22 is the sectional side view showing the switching part of the conventional circuit breaker in the way of the breaking operation.

Hereafter, a third embodiment of a circuit breaker in accordance with the present invention is described referring to the accompanying drawings of FIGS. 16(*a*) and 16(*b*).

FIG. 16(*a*) is a side view of an engagement mechanism in a circuit breaker of the third embodiment in accordance with present invention. FIG. 16(*b*) is a front view of the engagement mechanism of FIG. 16(*a*). Corresponding parts and components to the first embodiment are indicated by the same numerals and marks, and the description thereof in the first embodiment similarly apply. The differences and additional features of this third embodiment as compared with the first embodiment are as follows.

In the circuit breaker of the aforementioned second embodiment shown in FIGS. 15(*a*) and 15(*b*), the engagement mechanism for linking between the main contact 200 and the resistor contact 400 comprises the pusher 390, which is fixed to be supported by the first insulation operation rod 303, and the receiver 391 which is provided on the second insulation operation rod 353 to contact with the pusher 390.

In the circuit breaker of the third embodiment shown in FIGS. 16(*a*) and 16(*b*), the first shaft 601, which is connected to the first insulation operation rod for operating the main contact 200, has a pusher 395 for restricting the movement of the second shaft 651. The second shaft 651 is connected to the second insulation operation rod for operating the resistor contact 400. The second shaft 651 has a receiver 396, which is arranged to contact to a roller 395*b* of the pusher 395 when the main moving contact and the moving resistor contact are moved in closing directions. The roller 395*b* is rotatably supported by a pin 395*a* on the project end of the pusher 395. Since the receiver 396 is arranged to contact with the downward face 396*a* of the receiver 396, the engagement mechanism comprising the pusher 395 and the receiver 396 has the same effect as the aforementioned engagement mechanism of the first embodiment and the second embodiment.

According to the above-mentioned circuit breaker of the third embodiment, since the first shaft 601 and the second shaft 651 are linked with each other by using the linear simple up and down movement of the first shaft 601 and the second shaft 651, the engagement mechanism of the third embodiment is constructed with fewer parts than the aforementioned first embodiment. Also, since the engagement mechanism of the third embodiment is disposed in air, the circuit breaker of the third embodiment can be easily maintained and has higher reliability than the second embodiment.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A circuit breaker comprising: a tank filled with an insulation gas:

two main contacts which are electrically connected in series and provided in said tank in a manner such that main moving contacts of said main contacts are driven in an axial direction of said tank for contacting and departing from stationary main contacts of said main contacts;

series connections of resistors and a resistor contact are respectively provided in said tank in a manner so as to be electrically connected in parallel with said main contacts;

a first insulation operation rod and a second insulation operation rod which are driven in a direction perpendicular to the axis of said tank and provided between said main contacts;

a first link mechanism for coupling between one end of said first insulation operation rod and said main contact;

a second link mechanism for coupling between one end of said second insulation operation rod and said resistor contact;

a first hydraulic operation apparatus and a second hydraulic apparatus which are provided below said tank;

a third link mechanism for coupling between the other end of said first insulation operation rod and said first hydraulic operation apparatus;

a fourth link mechanism for coupling between the other end of said second insulation operation rod and said second hydraulic operation apparatus; and an engagement mechanism for restricting operations of said first link mechanism and second link mechanism in such a manner that said main contacts and said resistor contacts are moved so as to close at substantially the same speed, and said main contacts are closed after said resistor contacts are closed wherein, said engagement mechanism comprises a lever and a third link of which an end thereof is rotatably supported by a fixed base and the other end thereof is coupled to an end of said lever and wherein said main contacts and said resistor contacts are moved so as to close at substantially the same speed and said main contacts are closed after said resistor contacts are in a closed state in such a manner that the other end of said lever is kept in contact with a coupling point between said second link mechanism and said second lever in the closing operations of said main contacts and said resistor contacts.

2. A circuit breaker, comprising:

a tank filled with an insulation gas:

two main contacts which are electrically connected in series and provided in said tank in a manner such that main moving contacts of said main contacts are driven in an axial direction of said tank for contacting and departing from stationary main contacts of said main contacts;

series connections of resistors and a resistor contact are respectively provided in said tank in a manner so as to be electrically connected in parallel with said main contacts;

a first insulation operation rod and a second insulation operation rod which are driven in a direction perpendicular to the axis of said tank and provided between said main contacts;

a first link mechanism for coupling between one end of said first insulation operation rod and said main contact;

a second link mechanism for coupling between one end of said second insulation operation rod and said resistor contact;

a first hydraulic operation apparatus and a second hydraulic apparatus which are provided below said tank;

a third link mechanism for coupling between the other end of said first insulation operation rod and said first hydraulic operation apparatus;

a fourth link mechanism for coupling between the other end of said second insulation operation rod and said second hydraulic operation apparatus; and an engagement mechanism for restricting operations of said first link mechanism and second link mechanism in such a manner that said main contacts and said resistor contacts are moved to close at substantially the same speed, and said main contacts are closed after said resistor contacts are closed wherein moving directions of said two main contacts are opposite to each other in the breaking operation and the closing operation;

a moving direction of said first insulation operation rod is arranged perpendicular to the moving directions of said main contacts;

said first link mechanism comprises, a first link which is coupled to a main moving contact of said main contact, a second link which is coupled to an end of said first insulation operation rod and a first lever which is coupled between the other end of said second link and the other end of said first link and rotatably borne on a fixed base;

moving directions of said two resistor contacts are opposite to each other in the breaking operation and the closing operation;

a moving direction of said second insulation operation rod is arranged perpendicular to the moving directions of said resistor contact;

said second link mechanism comprises a fourth link which is coupled to a moving resistor contact of said resistor contact, a fifth link which is coupled to an end of said second insulation operation rod, and a second lever which is coupled between the other end of said fourth link and the other end of said fifth link and rotatably borne on a fixed base;

said third link mechanism comprises a first shaft which is provided below said first insulation operation rod and connected to a bottom end of said first insulation operation rod, and which is arranged to project to air through a first hermetic seal, a sixth link of which an end is coupled to said first shaft, a fifth lever of which an end is coupled to the other end of said sixth link and rotatably supported by an operation housing, and a first rod end which is coupled between the other end of said fifth lever and an end of a first hydraulic piston of said first hydraulic operation apparatus; and said fourth link mechanism comprises a second shaft which is provided below said second insulation operation rod and connected to a bottom end of said second insulation operation rod, and which is arranged to project to air through a second hermetic seal, an eighth link of which an end is coupled to said second shaft, and a fourth lever of which an end is coupled to the other end of said eighth link and rotatably supported by said operation housing, and a second rod end which is coupled between the other end of said fourth lever and an end of a second hydraulic piston of said second hydraulic operation apparatus.

3. A circuit breaker in accordance with claim 2 wherein, said engagement mechanism comprises a third lever and a third link of which an end is rotatably supported by said fixed base and the other end is coupled to an end of said third lever;

said main contact and said resistor contacts are moved to close at substantially the same speed, and said main contacts are closed after said resistor contacts are in a closed state in such a manner that the other end of said third lever is kept in contact with a coupling point between said fourth link and said second lever in the closing operations of said main contacts and said resistor contacts.

4. A circuit breaker in accordance with claim 3 further comprises latch mechanism which is provided to interlock between said third link mechanism and said fourth link mechanism, and to restrict the motion of said fourth link mechanism in the closed state of said main contacts and said resistor contacts;

said latch mechanism engaging with said fourth link mechanism to stop the breaking motion of said resistor contact operated by said second hydraulic operation apparatus when said main contacts start to move in a breaking direction;

further said latch mechanism being released from the engagement with said fourth link mechanism so as to break the resistor contact operated said second hydraulic operation apparatus when said fifth lever of said third link mechanism is rotated in a predetermined angle in the breaking operation of said main contact.

5. A circuit breaker in accordance with claim 2 wherein, said engagement mechanism comprises a pusher of which an end is fixed to said first insulation operation rod, and a receiver which is fixed to said a second insulation operation rod so as to contact to a tip end of said pusher;

said main contacts and said resistor contacts are moved to close at substantially the same speed, and said main contacts are closed after said resistor contacts are closed in a manner such that said tip end of said pusher keeps in contact with said receiver in the closing operation of said main contacts and said resistor contacts.

6. A circuit breaker in accordance with claim 5 further comprises a latch mechanism which is provided to interlock said third link mechanism and said fourth link mechanism and to restrict motion of said fourth link mechanism in the closed state of said main contacts and said resistor contacts;

said latch mechanism engaging with said fourth link mechanism to stop the breaking motion of said resistor contacts operated by said second hydraulic operation apparatus when said main contacts start to move in a breaking direction, and said latch mechanism being released from the engagement with said fourth link mechanism to break the resistor contacts operated said second hydraulic operation apparatus when said fifth lever of said third link mechanism is rotated in a predetermined angle in the breaking operation of said main contacts.

7. A circuit breaker in accordance with claim 2 wherein, said engagement mechanism comprises a pusher of which an end is fixed to said first shaft, and a receiver which is fixed to said second shaft so as to contact a tip end of said pusher, said main contacts and said resistor contacts are moved to close at substantially the same speed, and said main contacts are closed after said resistor contacts are closed in a manner such that said tip end of said pusher keeps in contact with said receiver in the closing operation of said main contacts and said resistor contacts.

8. A circuit breaker in accordance with claim 7 further comprises a latch mechanism which is provided to interlock said third link mechanism and said fourth link mechanism, and to restrict motion of said fourth link mechanism in the closed state of said main contacts and said resistor contacts, said latch mechanism engages with said fourth link mechanism to stop the breaking motion of said resistor contacts operated by said second hydraulic operation apparatus when said main contacts start to move in a breaking direction, said latch mechanism is released from engagement with said fourth link mechanism to break the resistor contact operated said second hydraulic operation apparatus when said fourth lever of said third link mechanism is rotated through a predetermined angle in the breaking operation of said main contacts.

* * * * *